US011504642B2

(12) United States Patent
Goldiner et al.

(10) Patent No.: US 11,504,642 B2
(45) Date of Patent: Nov. 22, 2022

(54) MOUTH-OPERATED MOVEABLE APPARATUS

(71) Applicant: SCARECROW, INC., Grover Beach, CA (US)

(72) Inventors: Arthur H. Goldiner, Nipomo, CA (US); Saundra Clay, Guadalupe, CA (US); Linda B. Camplese, Nipomo, CA (US)

(73) Assignee: Scarecrow, Inc., Grover Beach, CA (US)

( * ) Notice: Subject to any disclaimer, the term of this patent is extended or adjusted under 35 U.S.C. 154(b) by 597 days.

(21) Appl. No.: 16/549,269

(22) Filed: Aug. 23, 2019

(65) Prior Publication Data

US 2021/0052992 A1 Feb. 25, 2021

(51) Int. Cl.
*A63J 7/00* (2006.01)
*A63J 5/02* (2006.01)

(52) U.S. Cl.
CPC ..... *A63J 7/00* (2013.01)

(58) Field of Classification Search
CPC ..... A63H 33/00; A63H 3/003; A63H 37/00; A63H 37/005; A63J 5/02; A63J 7/00
USPC ..... 446/26–27; 472/51, 54, 70
See application file for complete search history.

(56) References Cited

U.S. PATENT DOCUMENTS

| | | | | |
|---|---|---|---|---|
| 1,214,028 | A * | 1/1917 | Hainert, Jr. | A63H 33/00 2/206 |
| 4,676,500 | A * | 6/1987 | Fricano | A63H 37/00 D21/661 |
| 4,694,956 | A * | 9/1987 | Sims | A61C 19/008 206/83 |
| 5,083,770 | A * | 1/1992 | Holland | A63J 7/00 472/70 |
| 8,206,231 | B2 | 6/2012 | Zuloff | |

* cited by examiner

*Primary Examiner* — Kien T Nguyen
(74) *Attorney, Agent, or Firm* — Fitch, Even, Tabin & Flannery LLP

(57) ABSTRACT

Systems and methods for operating a mouth-operated moveable apparatus are described. The apparatus may include a case, a mechanism coupled to the case, and a curved band having a first end coupled to the mechanism and a free second end, wherein the mechanism includes a biasing element automatically holding the band in a first position, wherein the case and mechanism are configured such that when the apparatus is placed in the mouth of a user the mechanism is actuatable by a jaw movement of the user, and where the actuation of the mechanism moves the band from the first position to a second position.

21 Claims, 20 Drawing Sheets

MOUTH-OPERATED MOVEABLE APPARATUS

BACKGROUND OF THE INVENTION

1. Field of the Invention

The present invention relates generally to operating a mouth-operated apparatus, and more specifically to a mouth-operated apparatus that is moved with a movement of the jaw.

2. Discussion of the Related Art

Various systems and processes are known in the art for operating a mouth-operated apparatus. For example, some systems include a horizontal rod pivotable by the user's tongue. In such a system, pivoting rotates ends of the rod between an upper and lower position. The different positions may be used to control accessories such as fake teeth (i.e., for a costume).

For example, a fake tooth may be attached to each end of the rod, whereby when the rod is in the upper position the fake teeth are hid behind the upper lip, and when the rod is in the lower position the fake teeth are seen below the top lip. However, using the tongue to operate a mechanism may be difficult for the user, grossly obstructs normal speech, and tends to cause drooling. What is needed is an apparatus that is automatically held in a first position in the mouth and is easily moved to a second position using a slight jaw movement.

SUMMARY OF THE INVENTION

A mouth-operated moveable apparatus is described. The apparatus may include a case, a mechanism coupled to the case, and a curved band having a first end coupled to the mechanism and a free second end, wherein the mechanism includes a biasing element automatically holding the band in a first position, wherein the case and mechanism are configured such that when the apparatus is placed in the mouth of a user the mechanism is actuatable by a jaw movement of the user, and wherein the actuation of the mechanism moves the band from the first position to a second position.

A method of manufacturing a mouth-operated moveable apparatus is described. The method may include providing a case, providing a mechanism coupled to the case, and providing a curved band having a first end coupled to the mechanism and a free second end, wherein the mechanism includes a biasing element automatically holding the band in a first position, wherein the case and mechanism are configured such that when the apparatus is placed in the mouth of a user the mechanism is actuatable by a jaw movement of the user, and wherein the actuation of the mechanism moves the band from the first position to a second position.

A method for operating a mouth-operated apparatus is described. The method may include placing the apparatus in a mouth of a user, the apparatus comprising a case, a mechanism coupled to the case, and a curved band coupled to the case and actuating the mechanism of the apparatus by moving the jaw of the user whereby the band is moved from a first position to a second position.

A method for operating a mouth-operated apparatus is described. The method may include placing the apparatus in a mouth of a user, the apparatus comprising a case, a mechanism coupled to the case, and a band coupled to the case, actuating a mechanism of the apparatus by moving the jaw of the user whereby the band is moved from a first position to a second position, and releasing the mechanism by moving the jaw of the user generally opposite to the actuating motion, whereby the band remains in the second position.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

In this description, orientations are considered with respect to a mouth of the user when the apparatus is placed in the mouth of the user as described herein, i.e. left refers to the left side from the user's perspective.

Figure 1:
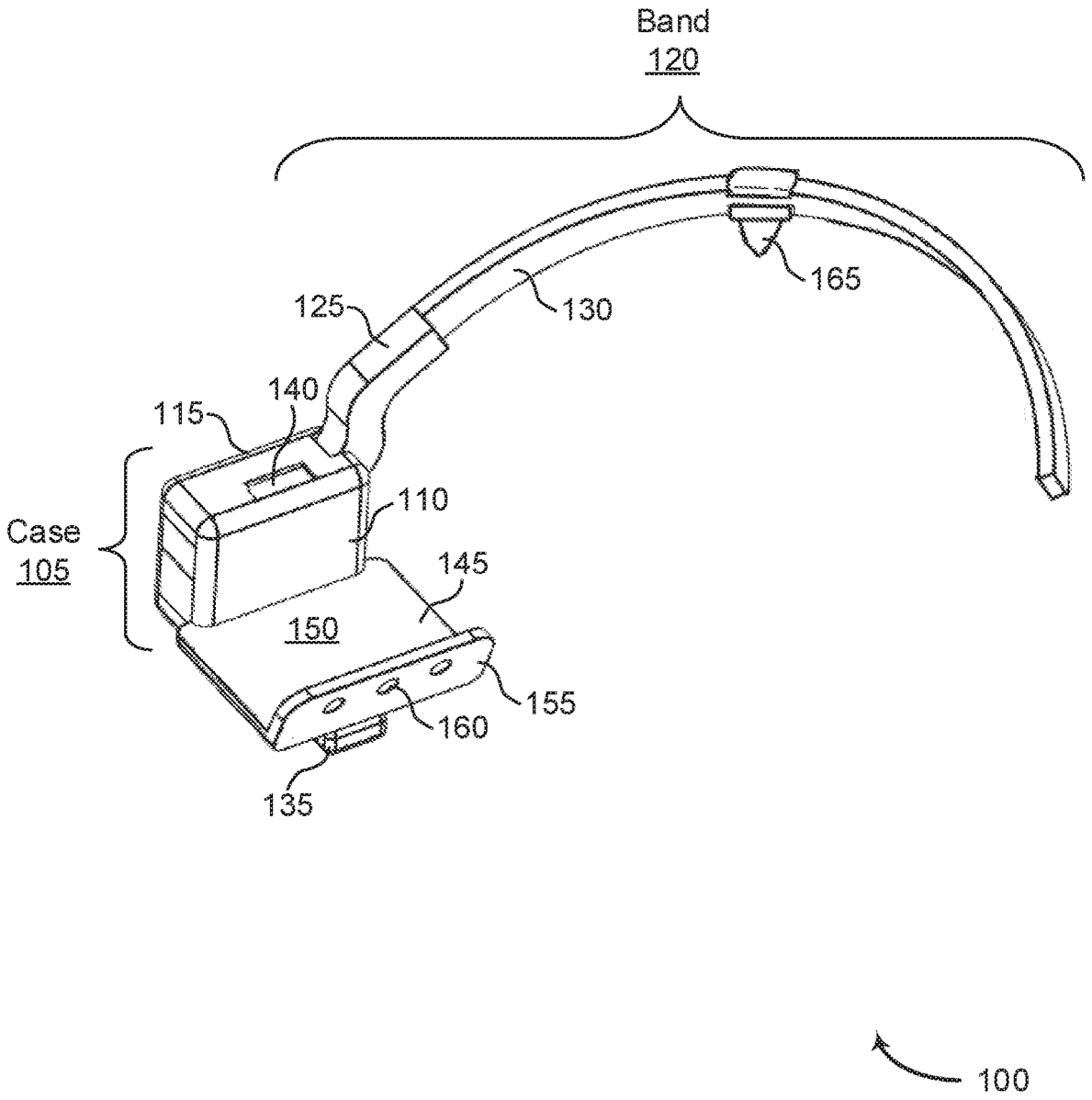
FIG. 1 shows an example of a perspective view of a mouth-operated moveable apparatus, in a first position, in a first embodiment of the present invention.

FIG. 1 shows an example of a perspective view of a mouth-operated moveable apparatus 100, in a first position, in a first embodiment of the present invention. The example shown includes mouth-operated moveable apparatus 100 and accessory 165.

Referring first to FIG. 1, a perspective view of a mouth-operated moveable apparatus 100 in a first position is shown. The mouth-operated moveable apparatus 100 comprises a case 105 and a curved band 120 moveably coupled to the case 105. Each case 105 comprises a case body 110, a case cover 115, a mechanism, and an actuator foot 135. A first end of the band 120 comprises a band anchor 125, which is coupled to the mechanism. A second end of the band 120 is a free end. The mechanism includes a biasing element to automatically hold the first end of the band 120, which is coupled to the mechanism, in the first position. In the first embodiment, the first position results in a portion of the band 120 distal to the case 105 located upwards relative to the case 105. In some embodiment the biasing element is a spring as shown in FIGS. 3, 4, 6, 7, 9, 12, 13. In other embodiments the biasing element may be a plastic flange or other structure suitable for biasing.

Actuation of the mechanism causes the band 120 to move between the first position and a second position. In the first embodiment, the second band 120 position is lower than the first position, as described below with reference to FIGS. 6 and 7.

While the embodiment of FIG. 1 shows the apparatus configured for fitting between the left teeth of the user, it will be understood by those of ordinary skill in the art that the apparatus may be configured in the mirror orientation, for fitting between the right teeth of the user. One or more accessories are configured for removably coupling to the band 120. In the exemplary embodiment of FIG. 1, one accessory 165 is shown. A plurality of accessories, in various shapes and types of coupling, is also contemplated. The accessory 165 may be coupled to the band 120 by a snap-fit connection as shown, or other suitable connection. In the embodiment shown in FIG. 1, the accessory 165 is tooth-shaped.

The case 105 may include a mechanism (not shown). The mechanism is situated within an interior cavity formed by the case cover 115 being coupled to the case body 110, forming a general box shape. In the present embodiment, the coupling of the case cover 115 to the case body 110 may be a removable fitting such as a snap-fit coupling.

Figure 17A:
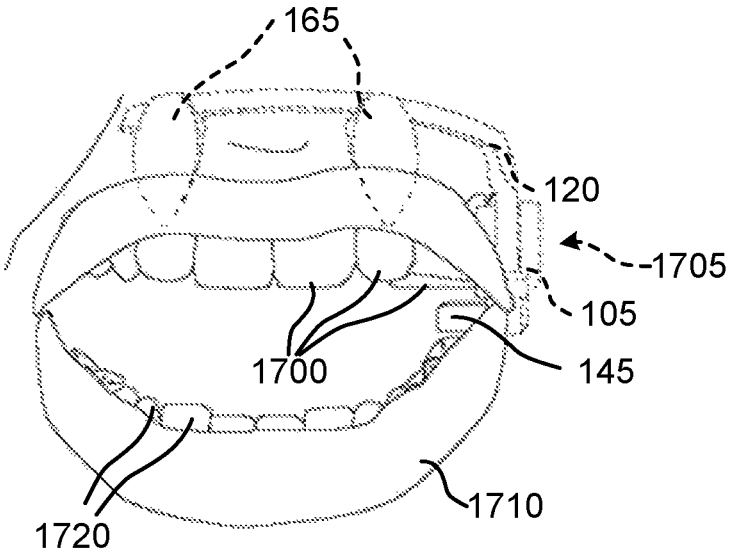
FIGS. 17A, 18A, 18C, 19A, and 20A show examples of a state of operation of a mouth-operated apparatus when a jaw of the user is in a rest position.

The case body 110 may include or be coupled to a generally horizontal bite plate 145 extending inward (with reference to the mouth of the user) from a lower inward edge of the box shape. The bite plate flange 155 extends upwards from an inward edge of the bite plate 145 and includes a plurality of bite plate holes 160. A generally vertical inward box surface of the case body 110, a generally horizontal bite plate surface 150, and a flange surface generally facing the inward box surface form a tooth receptacle for receiving an upper tooth 1700 (or an upper tooth plus a portion of an adjacent upper tooth, or a plurality of upper teeth, depending on the location of the apparatus in the mouth of the user and a length of the bite plate 145) within the receptacle, with the inward box surface and the flange surface keeping the tooth 1700 between the two surfaces and above the bite plate 145, as shown in FIG. 17A. The underside of the upper tooth 1700 (or upper teeth) is juxtaposed with the bite plate surface 150 when the apparatus is placed in the user's mouth 1710 and the apparatus is operated, with the box portion of the case 105 located between the teeth 1700 and the buccal wall 1705 (i.e. the inside of the cheek).

In some examples, the apparatus is configured such that when placed in the mouth 1710 at least a portion of the at least one accessory 165 is visible when the band 120 is in the first position, and each accessory 165 is not visible when the band 120 is in the second position, as shown in FIGS. 19A, 19B, 20A, and 20B.

In some examples, the apparatus is configured such that the first position is an upward position, and the second position is a downward position, such as shown in FIGS. 1, 2, 6, and 7, 17A, 17B, 18A and 18B.

In some examples, the band 120 includes a band arm 130 and a band anchor 125 having a first end and a second end, where the first band anchor 125 end is coupled to the case 105 and the second band anchor 125 end is coupled to an end of the band arm 130. In some embodiments the band arm 130 is comprised of plastic. In other embodiments the band arm 130 is comprised of metal. In other embodiments the band arm 130 is comprised of metal wire. In other embodiments the band arm 130 is comprised of a material suitable for being manufactured in a shape capable of performing the required functions of the band arm 130.

Accordingly, mouth-operated moveable apparatus 100 may be placed in the mouth of a user, the apparatus including a case 105, a mechanism coupled to the case 105, and a curved band 120 coupled to the case 105. In some examples, the placing of the apparatus in the mouth 1710 of the user includes locating a portion of the case 105 and a portion of the mechanism between upper teeth 1700 and lower teeth 1720 of the user, and where actuating the mechanism includes biting of the portions of the case 105 and mechanism between the upper teeth 1700 and lower teeth 1720 of the user. In some examples, the placing of the apparatus in the mouth 1710 includes the band 120 being juxtaposed with and generally following an outer surface of at least one of the user's upper teeth 1700 and the user's upper gums. In some examples, the moving of the jaw 1805 of the user includes moving the upper teeth 1700 and lower teeth 1720 closer together.

Mouth-operated moveable apparatus 100 may be an example of, or include aspects of, the corresponding element or elements described with reference to FIGS. 2-13. Mouth-operated moveable apparatus 100 may include case 105, band 120, actuator foot 135, slide plate 140, and bite plate 145. Case 105 may include case body 110 and case cover 115.

Band 120 may include band anchor 125 and band arm 130. Band 120 may have a first end coupled to the mechanism and a free second end, wherein the mechanism includes a biasing element automatically holding the band 120 in a first position, wherein the case 105 and mechanism are configured such that when the apparatus is placed in the mouth of a user the mechanism is actuatable by a jaw movement of the user, and wherein the actuation of the mechanism moves the band 120 from the first position to a second position.

In some examples, the first position is an upper position relative to the mouth 1710 of the user when the apparatus is placed in the mouth 1710 and the second position is a lower position relative to the mouth 1710. In some examples, the first position is a lower position relative to the mouth 1710 of the user when the apparatus is placed in the mouth 1710 and the second position is an upper position relative to the mouth 1710. In some examples, the first band 120 end is pivotally coupled to the case 105. In some examples, the band 120 is located between an outer surface of the teeth 1700 of the user and a buccal wall 1705 (inner check) of the user when the apparatus is placed in the mouth 1710 of the user. In some examples, the band 120 is configured to removably couple to at least one accessory 165.

In some examples, the first position is an upper position relative to the mouth 1710 of the user and the second position is a lower position relative to the mouth 1710. In some examples, the first position is a lower position relative to the mouth 1710 of the user and the second position is an upper position relative to the mouth 1710.

Actuator foot 135 may be coupled to a lower end of the mechanism, wherein when the actuator foot 135 is oriented generally parallel to and underneath the bite plate 145, the mechanism is actuatable by moving the actuator foot 135 upwards towards the bite plate 145. In some examples, the orientation of the actuator foot 135 is a first position and the actuator foot 135 is rotatable about the coupling to the lower end of the mechanism between the first position and a second position. In some examples, the second position is generally perpendicular to the bite plate 145.

Slide plate 140 may be moveably coupled to the case 105, wherein the coupling of the first end to the mechanism includes a pivotal coupling of the first band 120 end to the slide plate 140, and wherein actuating of the mechanism includes moving of the slide plate 140 relative to the case 105, whereby the first band 120 end is pivoted about the pivotal coupling to the case 105. In some examples, the actuation includes moving an actuator portion of the mechanism relative to the case 105.

Bite plate 145 may be located proximate to a lower edge of the case body 110 and extending outward from the case body 110 towards the mouth interior when the apparatus is placed in the mouth. Bite plate 145 may include bite plate surface 150 and bite plate flange 155.

Bite plate flange 155 may comprise a flange extending generally upwards from an end of the bite plate 145 distal to the case body 110, whereby a tooth receptacle for receiving one or more upper teeth is formed by the case body 110, the bite plate 145, and the flange. Bite plate flange 155 may include bite plate holes 160.

In some cases, at least one accessory 165 may be coupled to the band 120. In some examples, the coupling of the at least one accessory 165 is a snap-fit coupling. In some examples, the at least one accessory 165 is tooth-shaped.

An accessory 165 may be coupled to the band 120 prior to actuating. In some examples, at least one of the at least one accessory 165 is not visible when the user's jaw 1805 is in rest position and the band 120 is in the first position, and where the accessory 165 is at least partially visible when the band 120 is in the second position, as shown in FIGS. 17A, 17B, 18A, and 18B. In some examples, at least one of the at least one accessory 165 is at least partially visible when the user's jaw 1805 is in rest position and the band 120 is in the first position, and where the accessory 165 is not visible when the band 120 is in the second position, as shown in FIGS. 19A, 19B, 20A, and 20B.

Figure 2:
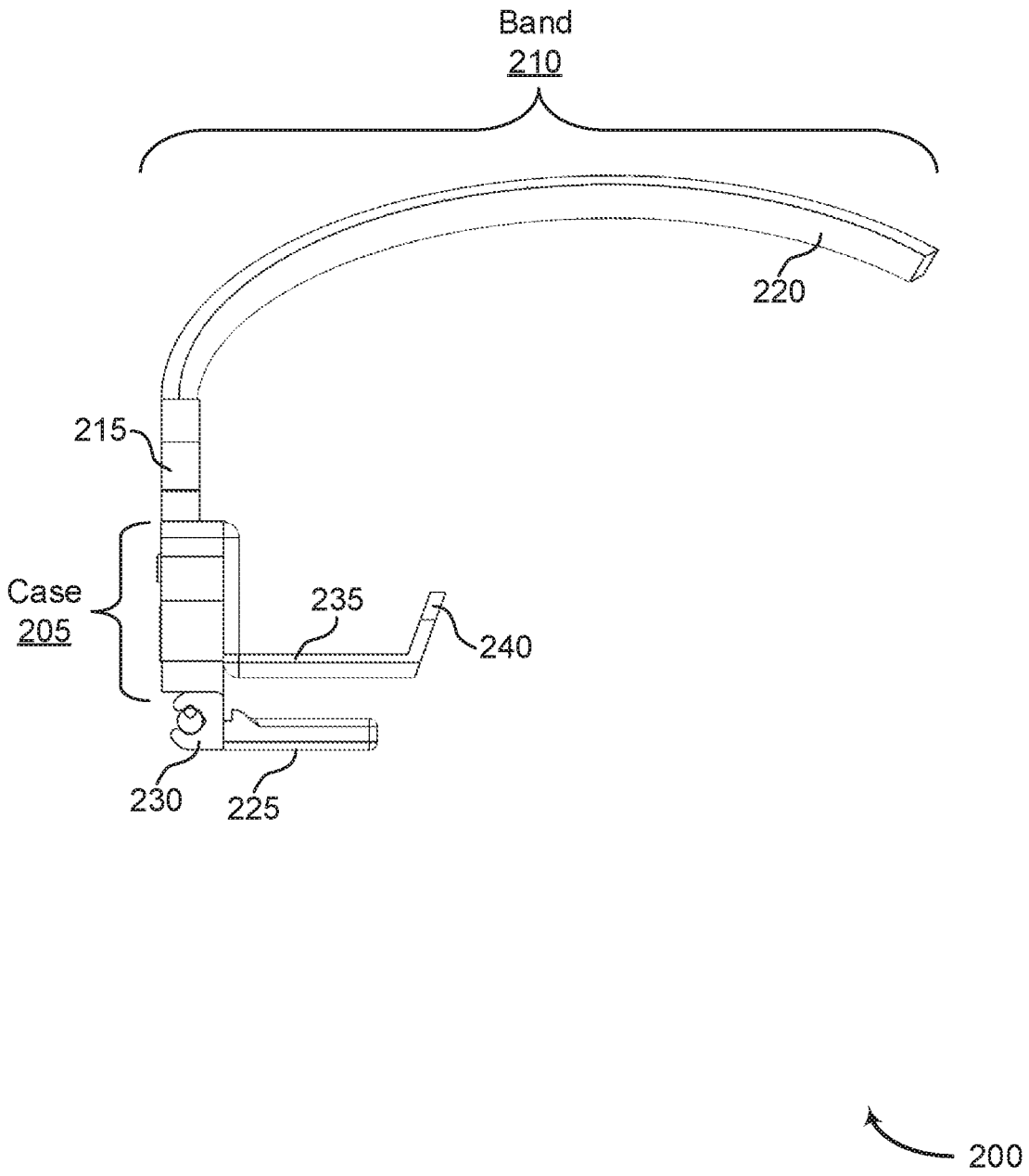
FIG. 2 shows an example of a rear elevational view of the mouth-operated moveable apparatus shown in FIG. 1 in accordance with aspects of the present disclosure.

FIG. 2 shows an example of a rear elevational view of the mouth-operated moveable apparatus shown in FIG. 1 in accordance with aspects of the present disclosure. Mouth-operated moveable apparatus 200 may include case 205, band 210, actuator foot 225, clip 230, and bite plate 235.

Case 205 may be an example of, or include aspects of, the corresponding element or elements described with reference to FIGS. 1, 4-8, and 11-13.

Band 210 may include band anchor 215 and band arm 220. Band 210 may be an example of, or include aspects of, the corresponding element or elements described with reference to FIGS. 1, 4, 6, 8, and 13. Band anchor 215 may be an example of, or include aspects of, the corresponding element or elements described with reference to FIGS. 1, 4, 6-8, and 11-13. Band arm 220 may be an example of, or include aspects of, the corresponding element or elements described with reference to FIGS. 1, 8, and 13.

Actuator foot 225 may be an example of, or include aspects of, the corresponding element or elements described with reference to FIGS. 1, 3, 4, 8, 11, and 13. Clip 230 may be an example of, or include aspects of, the corresponding element or elements described with reference to FIG. 3.

Bite plate 235 may include bite plate flange 240. Bite plate 235 may be an example of, or include aspects of, the corresponding element or elements described with reference to FIGS. 1, 4, 8, and 11. Bite plate flange 240 may be an example of, or include aspects of, the corresponding element or elements described with reference to FIGS. 1, 4, 8, and 11.

Figure 3:
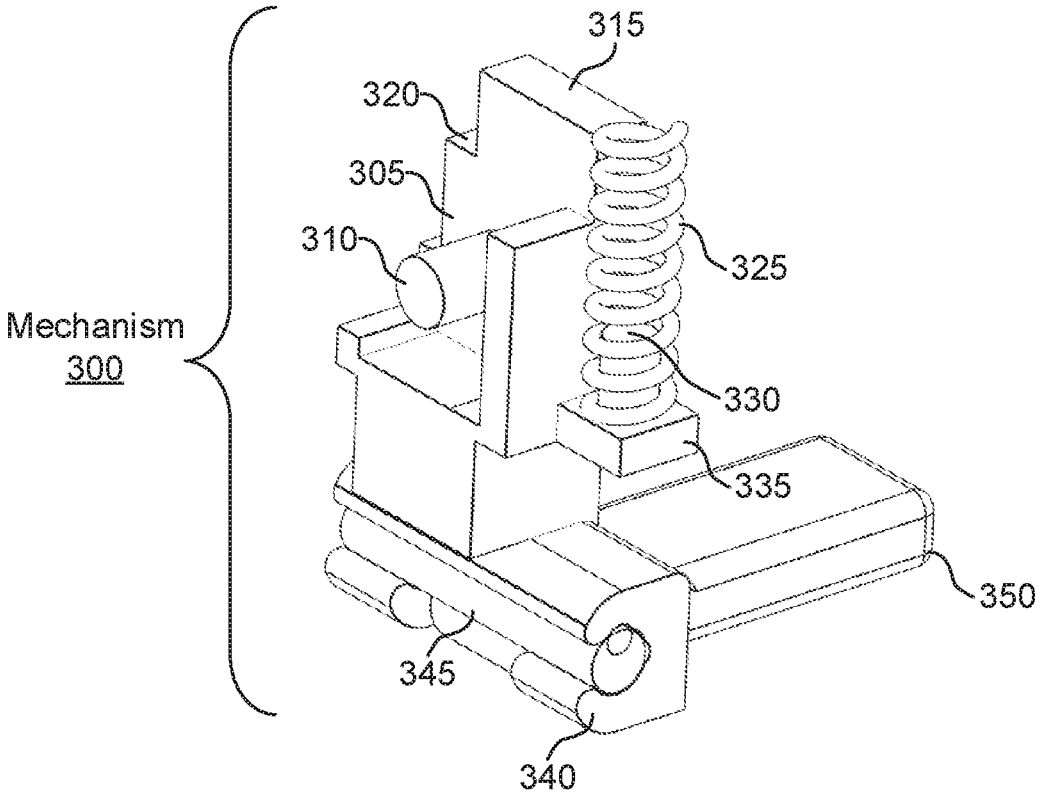
FIG. 3 shows an example of a perspective view of a mechanism of the mouth-operated moveable apparatus of FIG. 1 in accordance with aspects of the present disclosure.

FIG. 3 shows an example of a perspective view of a mechanism 300 of the mouth-operated moveable apparatus of FIG. 1 in accordance with aspects of the present disclosure. The example shown includes mechanism 300 and actuator foot 350.

Figure 4:
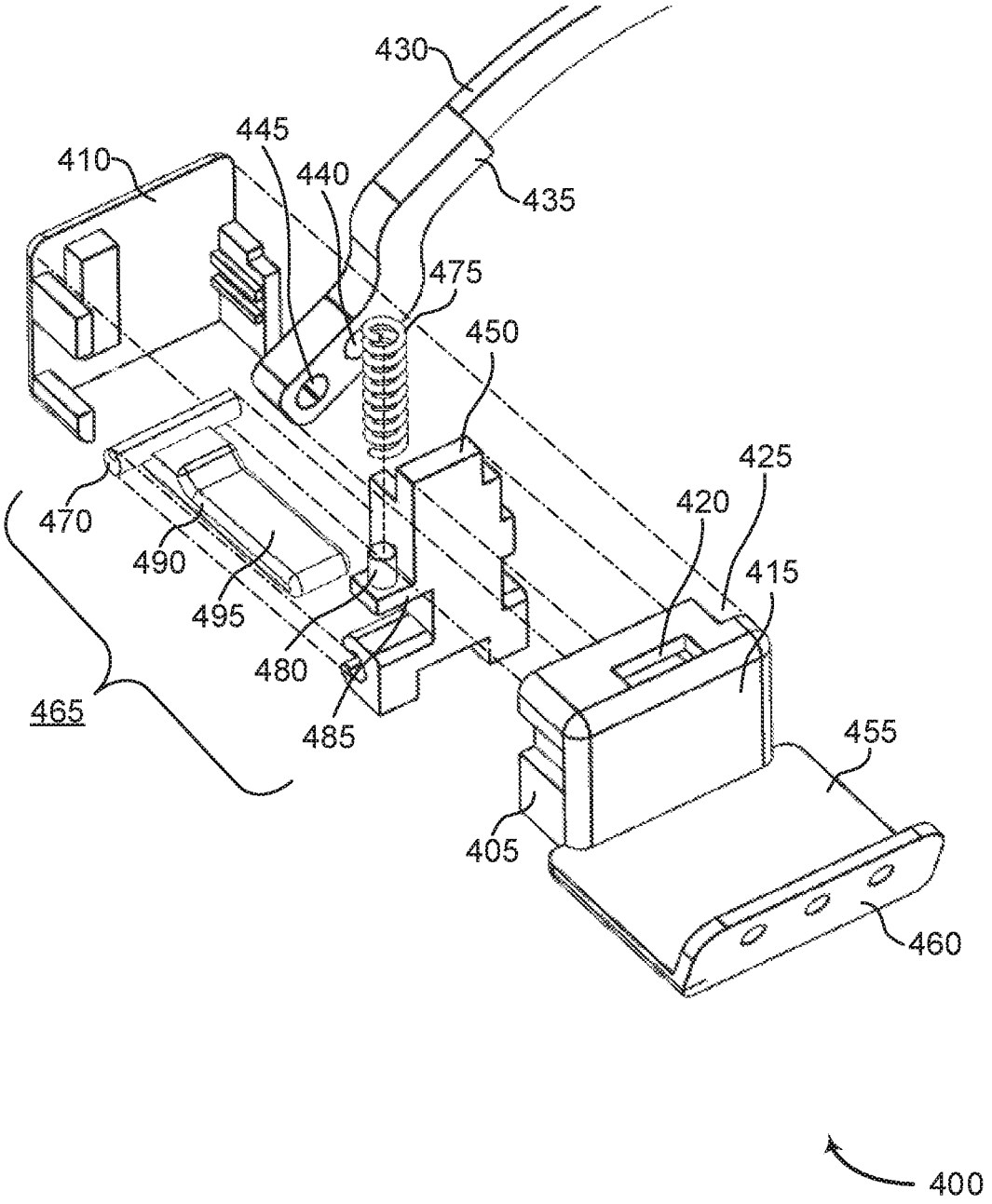
FIG. 4 shows an example of an exploded view of the mouth-operated moveable apparatus of FIG. 1 in accordance with aspects of the present disclosure.

The mechanism 300 includes the slide plate 305 moveably coupled to the case body and primarily housed within the interior cavity, with a portion extending downward through an opening in the underside of the case. During actuation, a portion of the slide plate 305 may also extend upwards through an opening in the case body, a top opening as shown in FIG. 4.

The slide plate 305 includes a generally horizontal spring base 335 extending laterally from a side of the slide plate 305, and a generally vertical spring pin 330 coupled to and extending upward from the spring base 335, both of which are configured to engage with the biasing element (a spring 325 in the present embodiment). The slide plate 305 includes a horizontal side plate pin 310 configured to couple to a corresponding hole in the band anchor. A lower end of the slide plate 305, located outside the case body, is coupled to an actuator foot 350.

In some embodiments, the slide plate 305 includes side-facing clips 340 and the actuator foot 350 includes a pivot rod 345, wherein the pivot rod 345 is snap fit to the clips 340 to rotatably couple the actuator foot 350 to the slide plate 305. This allows an actuator foot 350 body of the actuator foot 350 to rotate between the generally horizontal orientation shown in FIGS. 1-4 and a vertical downward orientation.

Figure 7:
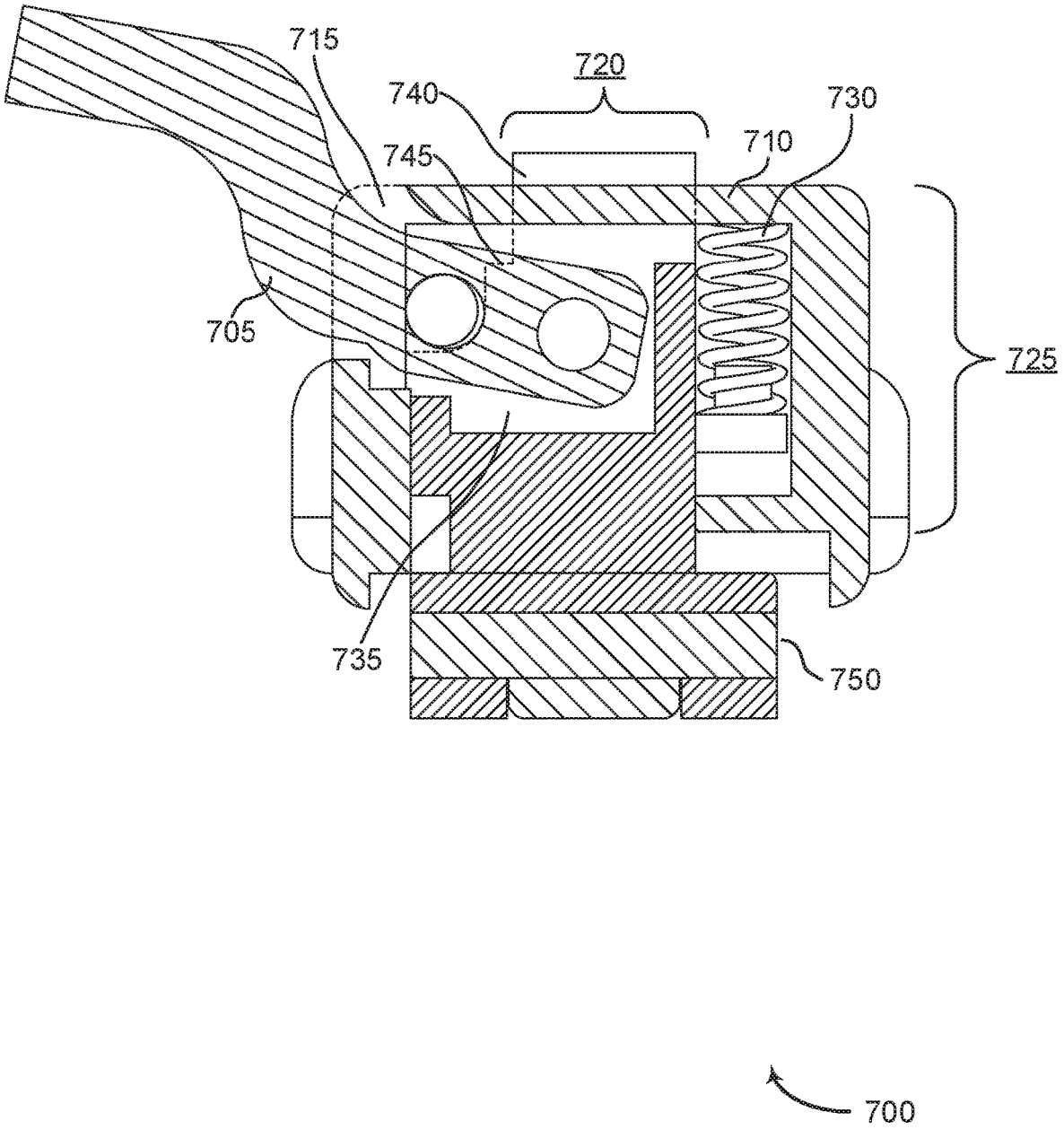
FIG. 7 shows an example of a sectional view of the mouth-operated moveable apparatus shown in FIG. 2, shown in the second position in accordance with aspects of the present disclosure.

The user may rotate the actuator foot 350 (either before placing it in the mouth or while wearing it) to provide an alternative fit in the mouth while the apparatus is not being actively used. In other embodiments, the actuator foot 350 may be rigidly coupled in the generally horizontal position to the lower portion of the slide plate 305. The slide plate 305 may also include a shelf 320 configured to contact the inner face of the top of the case body during actuation of the apparatus, whereby the upward movement of the slide plate 305 is stopped when the shelf 320 contacts the case body (as shown in FIG. 7).

The mechanism 300 includes the spring 325 (or other suitable biasing element) housed inside the interior cavity and placed to bias the slide plate 305 in a lower position relative to the case, such that the actuator foot 350 coupled to the slide plate 305 is in a first position relative to the bite plate of the case.

Mechanism 300 may be coupled to the case. Mechanism 300 may be actuated by moving the jaw of the user whereby the band is moved from a first position to a second position. The mechanism 300 is held in the second position by the user maintaining the jaw position. The apparatus configuration prevents the band from moving past the second position when the mechanism 300 is actuated. The user may actuate the mechanism 300 to an intermediate position of the band. For example, the user may move the jaw to actuate the mechanism to move the band from the first position to a position between the first position and the second position. In fact, the user may move the band to any intermediate position between the first position and the second position by moving the jaw.

It will be understood that the user does not have to maintain a constant force on the mechanism in order to keep the band in the second position. The second position may be maintained by the user providing at least as much force to the mechanism resulting in the shelf 320 continuously contacting the case body.

As the biasing element (spring 325 in the embodiment of FIG. 3) biases the mechanism towards the first position, moving the jaw of the user in the reverse of the actuating movement the pressure on the biasing element to be lessened as the jaw moves, whereby the band automatically moves from the second position back to the first position. Again, the band to be held in any intermediate position between the first position and the second position.

In another embodiment, after actuating the mechanism 300 the user would dis-engage from the mechanism 300 by moving the jaw of the user generally opposite to the actuating motion, whereby the band would remain in the second position. In that embodiment mechanism 300 would be re-actuated by moving the jaw of the user in the same manner as for actuating, whereby the band would be moved from the second position back to the first position. In other words, the position of the band would be toggled between the first and second positions by repeated actuation of the mechanism 300. Toggling of the band between the first position and second position is described further with respect to FIGS. 11-13.

Mechanism 300 may include slide plate 305, spring 325, spring pin 330, seat 335, clip 340, and pivot rod 345. In some examples, the mechanism 300 includes a biasing element which automatically holds the band in the first position. Mechanism 300 may be an example of, or include aspects of, the corresponding element or elements described with reference to FIGS. 4, 6, 7, 12, and 13.

Slide plate 305 may include slide plate pin 310, slide plate wall 315, and shelf 320. Slide plate 305 may be an example of, or include aspects of, the corresponding element or elements described with reference to FIGS. 1, 4-7, 9-11, and 13. Slide plate pin 310 may be an example of, or include aspects of, the corresponding element or elements described with reference to FIGS. 5, 9, and 10.

Slide plate wall 315 may be an example of, or include aspects of, the corresponding element or elements described with reference to FIGS. 5 and 7. Shelf 320 may be an example of, or include aspects of, the corresponding element or elements described with reference to FIG. 7.

Spring 325 may be an example of, or include aspects of, the corresponding element or elements described with reference to FIGS. 4, 6, and 7. Spring pin 330 and Seat 335 may be examples of, or include aspects of, the corresponding elements described with reference to FIG. 4. Clip 340 may be an example of, or include aspects of, the corresponding element or elements described with reference to FIG. 2. Pivot rod 345 may be an example of, or include aspects of, the corresponding element or elements described with reference to FIG. 4. Actuator foot 350 may be an example of, or include aspects of, the corresponding element or elements described with reference to FIGS. 1, 2, 4, 8, 11, and 13.

FIG. 4 shows an example of an exploded view of the mouth-operated moveable apparatus 400 of FIG. 1 in accordance with aspects of the present disclosure. Mouth-operated moveable apparatus 400 may include case 405, band 430, slide plate 450, bite plate 455, mechanism 465, and actuator foot 490.

The band 430 includes the band anchor 435, which is moveably coupled to the case 405 and the mechanism 465, and is rotated about a pivot point when the mechanism 465 is activated. The band anchor 435 includes a first hole 440 and a second hole 445. In the embodiment shown in FIGS. 1-4, the first hole 440 receives a case 405 pin extending into the interior cavity from a case 405 wall of the case 405, and is perpendicular to the case 405 wall.

Figure 5:
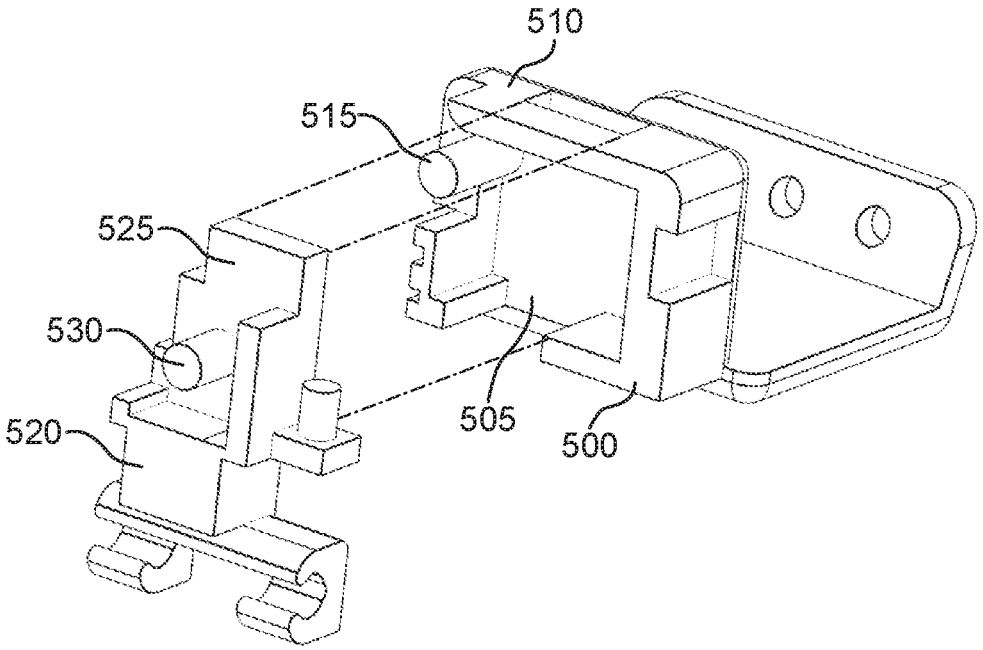
FIG. 5 shows an example of an exploded view of a slide plate and a case of the mouth-operated moveable apparatus of FIG. 1 in accordance with aspects of the present disclosure.

The case pin (not visible in FIG. 4, shown as case pin 515 with respect to FIG. 5) is located closer to the band arm 430 than the slide plate pin (not visible in FIG. 4, shown as slide plate pin 530 with respect to FIG. 5). In this way the band anchor 435 is coupled to and pivotable about a case pin pivot point by the first hole 440 receiving the case pin. The second hole 445 receives the slide plate pin extending into the interior cavity from a slide plate wall of the slide plate 450 (as shown by the slide plate pin 530 of FIG. 5), and the slide plate pin generally parallel to the case pin. The band anchor 435 is coupled to and is pivotable about the slide plate pin.

The band 430 (excluding the band anchor 435) configured for coupling the accessories may comprise a metal wire and have rectangular cross-section. In some embodiment the band 430 comprises plastic. The band 430 (excluding the band anchor 435) may be manually adjustable to provide a personalized fit for the user. The length of the band 430 may vary, depending on the preferred length available for accessory attachment. In one embodiment the length of the band 430 portion not including the band anchor 435 is within the range of 10 mm to 80 mm.

Case 405 may include case cover 410 and case body 415. Case 405 may be an example of, or include aspects of, the corresponding element or elements described with reference to FIGS. 1, 2, 5-8, and 11-13. Case cover 410 may be an example of, or include aspects of, the corresponding element or elements described with reference to FIGS. 1, 5, 8, 11, and 13.

Case body 415 may include top opening 420 and slide opening 425. Case body 415 may be an example of, or include aspects of, the corresponding element or elements described with reference to FIGS. 1, 6, 8, and 11-13. Top opening 420 may be an example of, or include aspects of, the corresponding element or elements described with reference to FIGS. 7 and 8. Slide opening 425 may be an example of, or include aspects of, the corresponding element or elements described with reference to FIGS. 7 and 8.

Band 430 may include band anchor 435. Band 430 may be an example of, or include aspects of, the corresponding element or elements described with reference to FIGS. 1, 2, 6, 8, and 13. Band anchor 435 may include first hole 440 and second hole 445. Band anchor 435 may be an example of, or include aspects of, the corresponding element or elements described with reference to FIGS. 1, 2, 6-8, and 11-13.

Slide plate 450 may be an example of, or include aspects of, the corresponding element or elements described with reference to FIGS. 1, 3, 5-7, 9-11, and 13. Bite plate 455 may include bite plate flange 460. Bite plate 455 may be an example of, or include aspects of, the corresponding element or elements described with reference to FIGS. 1, 2, 8, and 11. Bite plate flange 460 may be an example of, or include aspects of, the corresponding element or elements described with reference to FIGS. 1, 2, 8, and 11.

Mechanism 465 may include pivot rod 470, spring 475, spring pin 480, and seat 485. Pivot rod 470 may be an example of, or include aspects of, the corresponding element or elements described with reference to FIG. 3. Spring 475 may be an example of, or include aspects of, the corresponding element or elements described with reference to FIGS. 3, 6, and 7. Spring pin 480 and seat 485 may examples of, or include aspects of, the corresponding elements described with reference to FIG. 3.

Actuator foot 40 may include actuator foot body 495. Actuator foot 490 may be an example of, or include aspects of, the corresponding element or elements described with reference to FIGS. 1-3, 8, 11, and 13.

FIG. 5 shows an example of an exploded view of a slide plate and a case 500 of the mouth-operated moveable apparatus of FIG. 1 in accordance with aspects of the present disclosure. The example shown includes case 500 and slide plate 520. Case 500 may be an example of, or include aspects of, the corresponding element or elements described with reference to FIGS. 1, 2, 4, 6-8, and 11-13. Case 500 may include case wall 505, case cover 510, and case pin 515.

Case cover 510 may be an example of, or include aspects of, the corresponding element or elements described with reference to FIGS. 1, 4, 8, 11, and 13. Case pin 515 may be an example of, or include aspects of, the corresponding element or elements described with reference to FIGS. 6, 9, 10, 12, and 13.

Slide plate 520 may include slide plate wall 525 and slide plate pin 530. Slide plate 520 may be an example of, or include aspects of, the corresponding element or elements described with reference to FIGS. 1, 3, 4, 6, 7, 9-11, and 13. Slide plate wall 525 may be an example of, or include aspects of, the corresponding element or elements described with reference to FIGS. 3 and 7. Slide plate pin 530 may be an example of, or include aspects of, the corresponding element or elements described with reference to FIGS. 3, 9, and 10.

Figure 6:
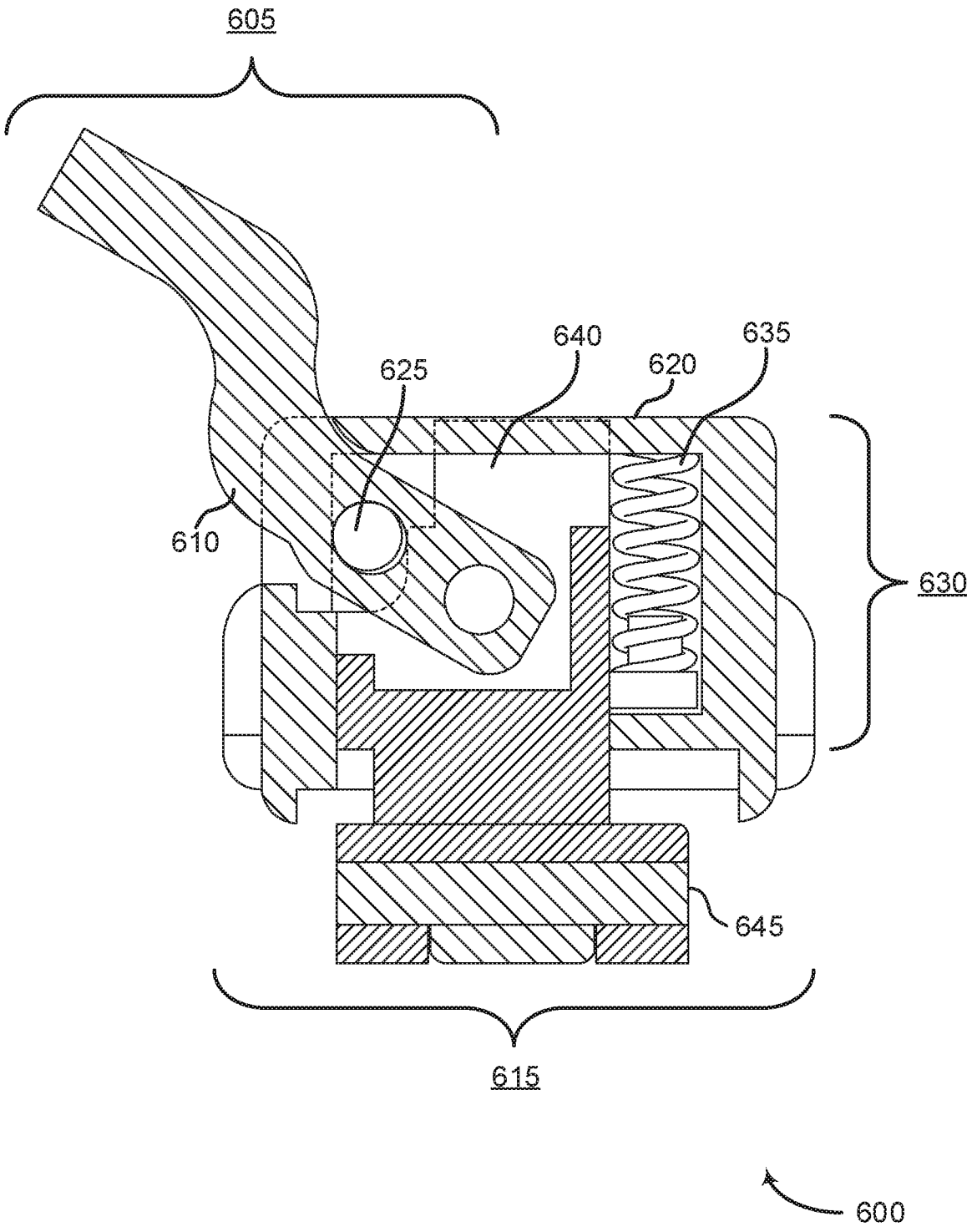
FIG. 6 shows an example of a sectional view of the mouth-operated moveable apparatus shown in FIG. 2, shown in the first position in accordance with aspects of the present disclosure.

FIG. 6 shows an example of a sectional view of the mouth-operated moveable apparatus shown in FIG. 2, shown in the first position in accordance with aspects of the present disclosure. Mouth-operated moveable apparatus 600 may include band 605, case 615, and mechanism 630.

In other words, FIG. 6 is a sectional view of the apparatus in the first position, when the mechanism 630 is not actuated and the band 605 is automatically held in the first position. FIG. 7 is a corresponding view of the case 615 with the mechanism 630 actuated and the band 605 moved to the second position.

In operation, the user places the apparatus in his mouth such that the generally horizontal bite plate and actuator foot 645 of each case 615 are located between the corresponding upper teeth 1710 and lower teeth 1720. The case body 620 is thereby located between the teeth 1710 and the inside of the cheek/buccal wall 1705, and the band 605 runs across the outside of the upper teeth 1720 and/or gum, but still inside the cheek/buccal wall 1705. Depending on the mouth movement of the user, the band 605 may or may not be visible in this first position.

Figure 18A:
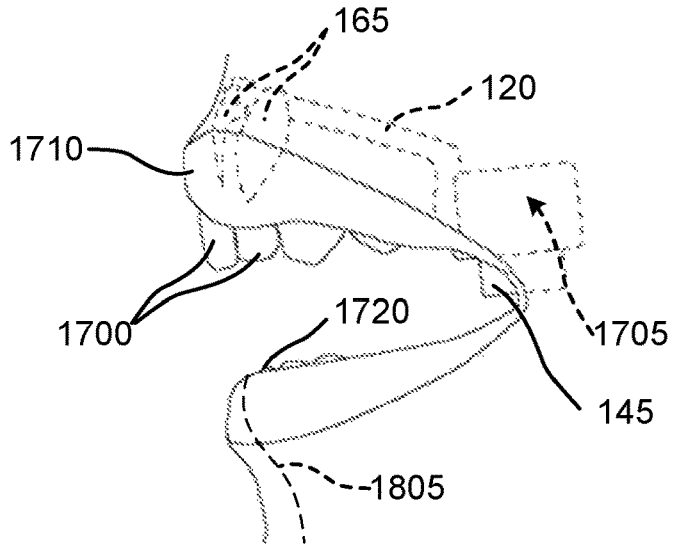

As shown in FIG. 6, in the first position, the spring 635 biases the slide plate 640 in a downward position, with the downward movement of the slide plate 640 arrested by a portion of the slide plate 640 (in this embodiment, the spring 635 base) contacting the case body 620. The actuator foot 645 is thereby a first distance from the bite plate, and the slide plate 640 pin is located downward from the case pin 625, causing the band anchor 610 to be angled upwards as shown in FIG. 6. This position in the mouth 1705 is shown in FIGS. 17A and 18A.

Band 605 may include band anchor 610. Band 605 may be an example of, or include aspects of, the corresponding element or elements described with reference to FIGS. 1, 2, 4, 8, and 13. Band anchor 610 may be an example of, or include aspects of, the corresponding element or elements described with reference to FIGS. 1, 2, 4, 7, 8, and 11-13.

Case 615 may include case body 620 and case pin 625. Case 615 may be an example of, or include aspects of, the corresponding element or elements described with reference to FIGS. 1, 2, 4, 5, 7, 8, and 11-13. Case body 620 may be an example of, or include aspects of, the corresponding element or elements described with reference to FIGS. 1, 4, 8, and 11-13. Case pin 625 may be an example of, or include aspects of, the corresponding element or elements described with reference to FIGS. 5, 9, 10, 12, and 13.

Mechanism 630 may include spring 635 and slide plate 640. Mechanism 630 may be an example of, or include aspects of, the corresponding element or elements described with reference to FIGS. 3, 4, 7, 12, and 13. Spring 635 may be an example of, or include aspects of, the corresponding element or elements described with reference to FIGS. 3, 4, and 7. Slide plate 640 may be an example of, or include aspects of, the corresponding element or elements described with reference to FIGS. 1, 3-5, 7, 9-11, and 13.

FIG. 7 shows an example of a sectional view of the mouth-operated moveable apparatus shown in FIG. 2, shown in the second position in accordance with aspects of the present disclosure. Mouth-operated moveable apparatus 700 may include band anchor 705, case 710, and mechanism 725.

When the user actuates the mechanism 725 by moving the jaw 1805 and bringing the upper teeth 1710 and lower teeth 1720 closer together, the user's teeth 1710, 1720 move the actuator foot 750 upward towards the bite plate. The upward movement is limited by a portion of the slide plate 735 contacting an upper portion of the case 710 body. As the user moves the actuator foot 750 closer to the bite plate, the slide plate 735 is simultaneously moved relative to the case 710 body since the actuator foot 750 is coupled to the slide plate 735.

Figure 17B:
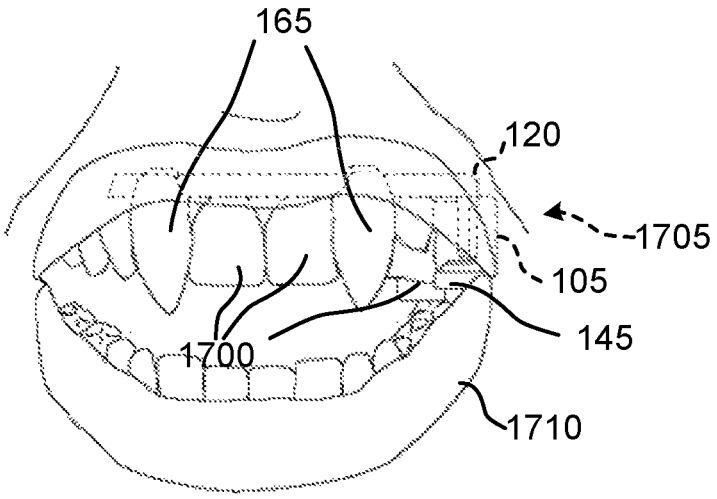
FIGS. 17B, 18B, 19B, and 20B show examples of a state of operation of a mouth-operated apparatus when a jaw of the user is in a clenched position.
Figure 18B:
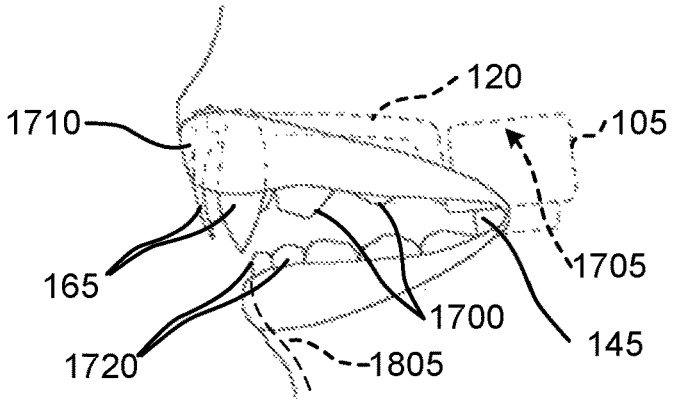

The upward movement of the slide plate 735 moves the slide plate 735 pin upwards relative to the case 710 pin, which causes the band anchor 705 to rotate counterclockwise about the case 710 pin to the second position shown in FIG. 7. This in turn lowers the distal portion of the band to a more horizontal position. This position in the mouth 1705 is shown in FIGS. 17B and 18B.

Due to the biasing element of the spring 730, as the user releases jaw pressure on the actuator foot 750, the spring 730 force automatically returns the slide plate 735 to the first position shown in FIG. 6 (and FIGS. 17A and 18A), whereby the band is returned to the first position.

When one or more accessories are coupled to the center portion of the band, the apparatus is configured such that the mechanism is located hidden or partially hidden the by the cheek/buccal wall of the user, and the accessories are hidden by the upper lip. When the user actuates the mechanism 725, the accessories are moved downward along with the band, becoming partially or fully visible. In one embodiment, the accessories are tooth-shaped, for example, vampire fang-shaped. When the user actuates the mechanism 725 in the embodiment with vampire fang-shaped accessories, the gradual appearance of the accessory mimics the "growth" of vampire fangs. When the user releases or otherwise disengages from the mechanism 725, the vampire fangs appear to "retract".

Band anchor 705 may be an example of, or include aspects of, the corresponding element or elements described with reference to FIGS. 1, 2, 4, 6, 8, and 11-13.

Case 710 may include slide opening 715 and top opening 720. Case 710 may be an example of, or include aspects of, the corresponding element or elements described with reference to FIGS. 1, 2, 4-6, 8, and 11-13. Slide opening 715 and top opening 720 may be examples of, or include aspects of, the corresponding element described with reference to FIGS. 4 and 8.

Mechanism 725 may include spring 730 and slide plate 735. Mechanism 725 may be an example of, or include aspects of, the corresponding element or elements described with reference to FIGS. 3, 4, 6, 12, and 13. Spring 730 may be an example of, or include aspects of, the corresponding element or elements described with reference to FIGS. 3, 4, and 6. Slide plate 735 may be an example of, or include aspects of, the corresponding element or elements described with reference to FIGS. 1, 3-6, 9-11, and 13.

Slide plate 735 may include slide plate wall 740 and shelf 745. Slide plate wall 740 may be an example of, or include aspects of, the corresponding element or elements described with reference to FIGS. 3 and 5. Shelf 745 may be an example of, or include aspects of, the corresponding element or elements described with reference to FIG. 3.

Figure 8:
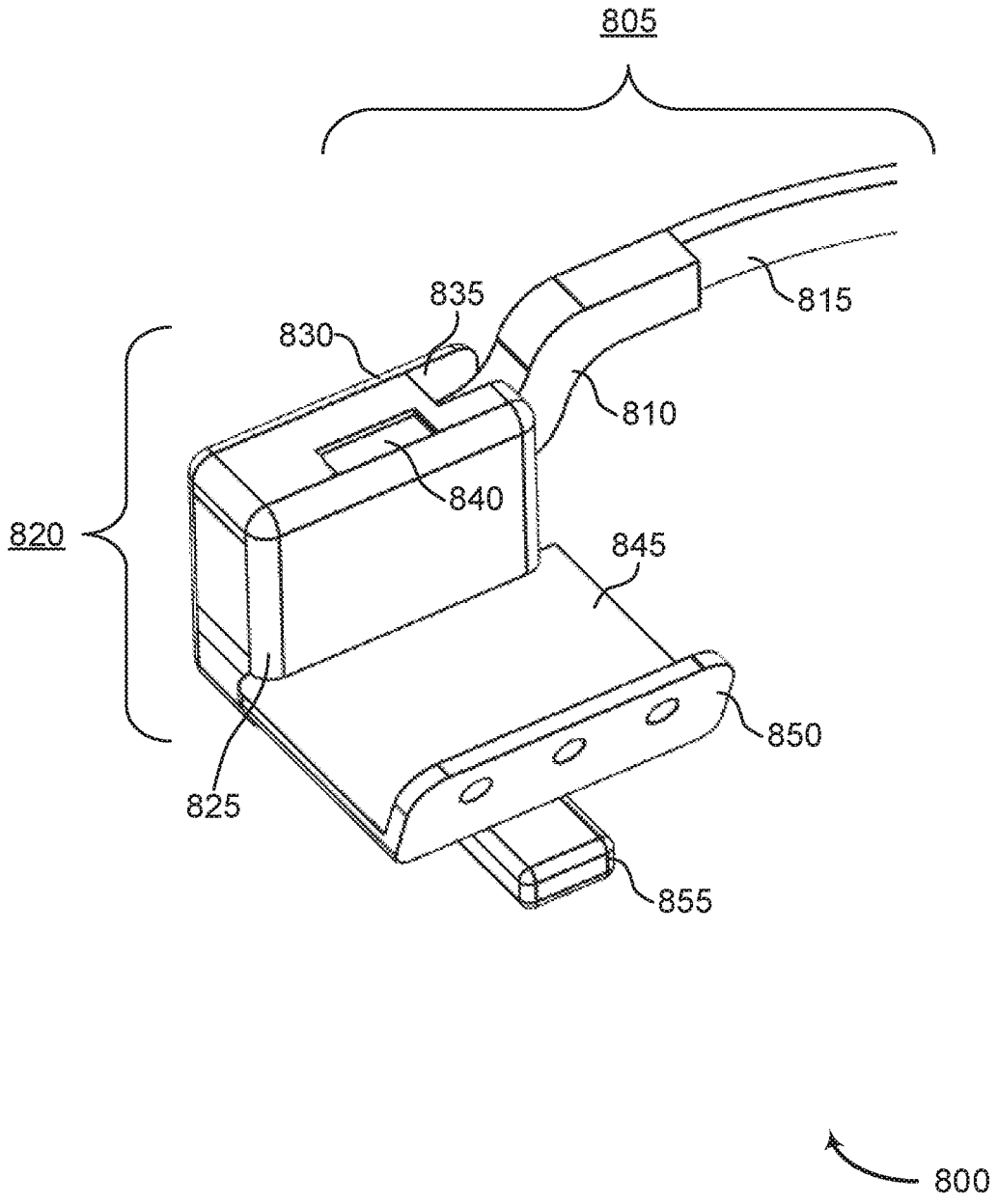
FIG. 8 shows an example of a perspective view of a mouth-operated moveable apparatus, in a first position, in a second embodiment of the present invention in accordance with aspects of the present disclosure.
Figure 9:
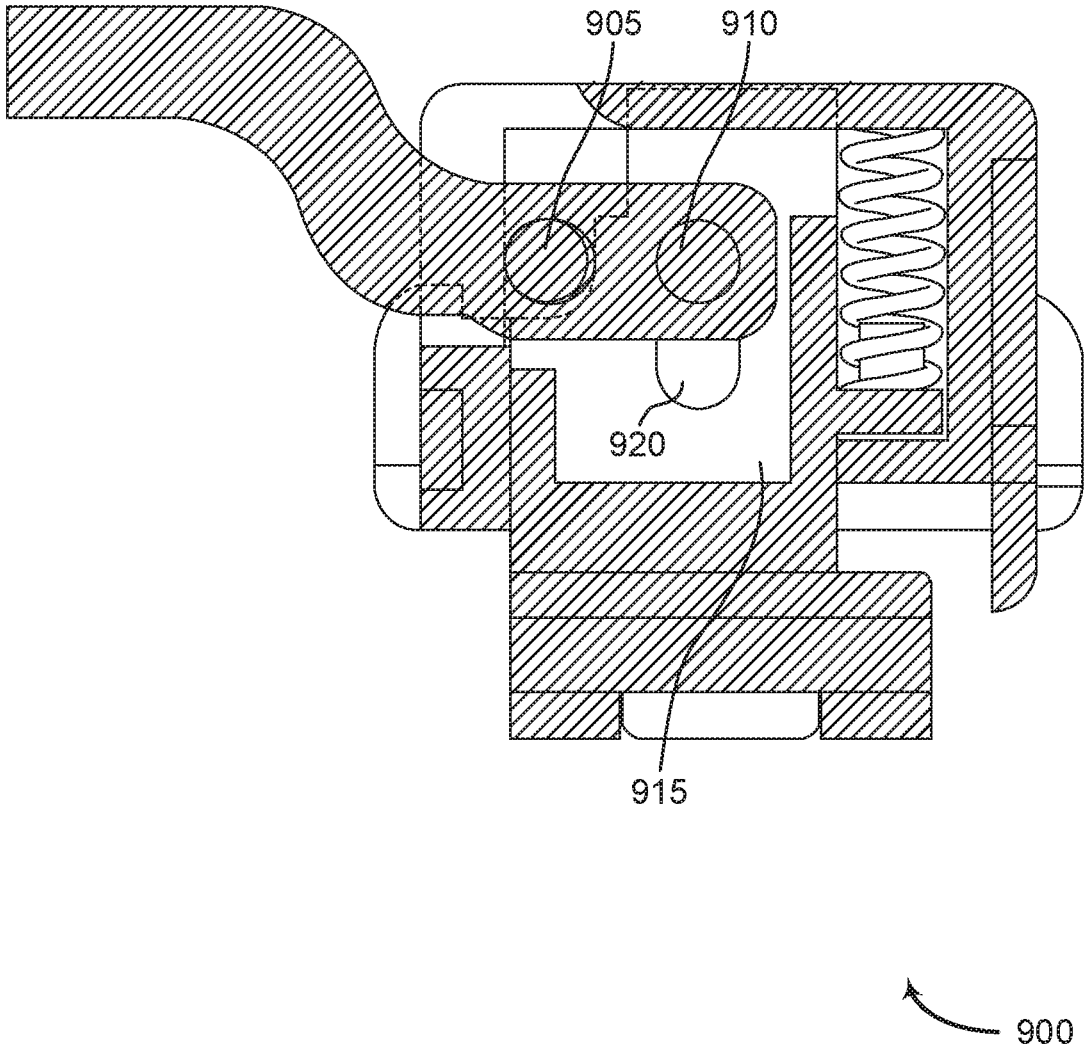
FIG. 9 shows an example of a sectional view of the mouth-operated moveable apparatus shown in FIG. 8, shown in the first position in accordance with aspects of the present disclosure.
Figure 10:
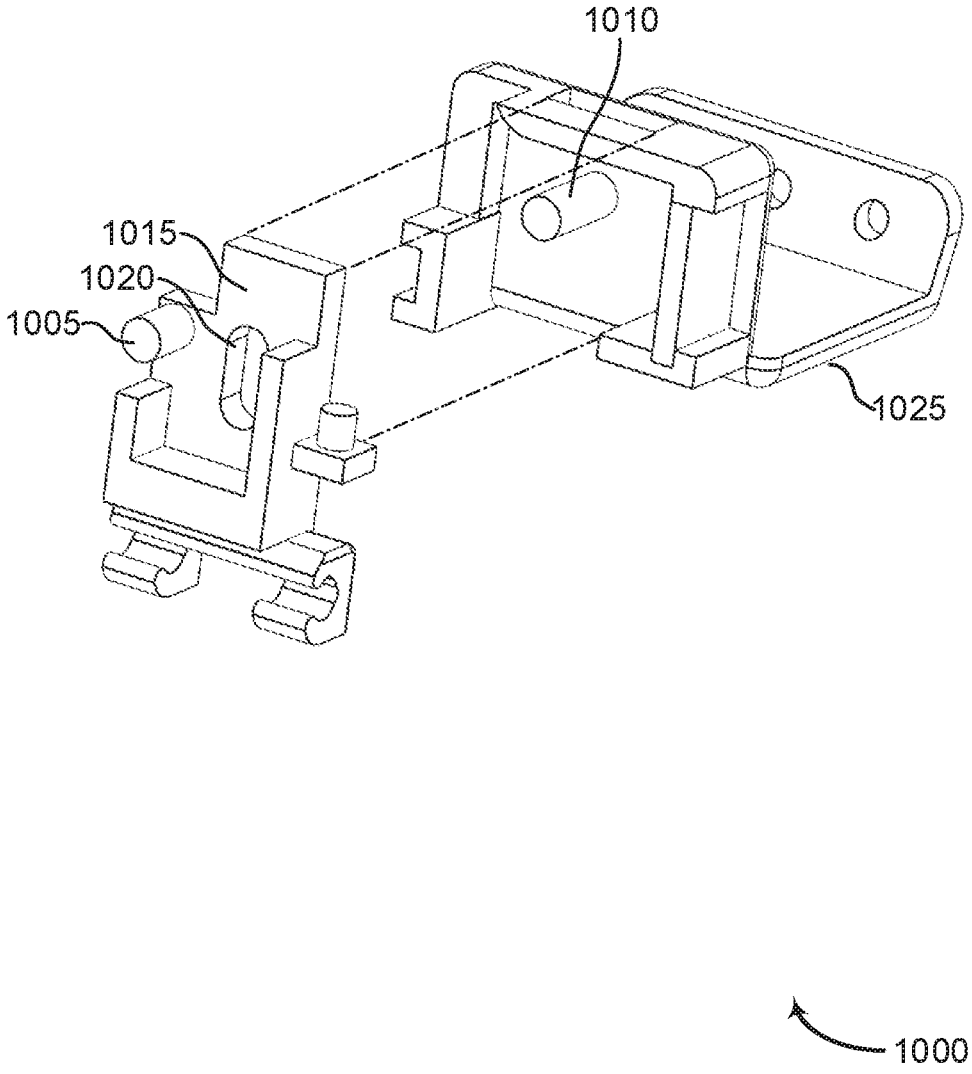
FIG. 10 shows an example of an exploded view of a slide plate and a case body of the mouth-operated moveable apparatus of FIG. 8 in accordance with aspects of the present disclosure.

Referring next to FIGS. 8-10, a second embodiment of the mouth-operated moveable apparatus 800 is shown. In the second embodiment, the first automatic position is a lower position, and actuation of the mechanism moves the band 805 upwards with respect to the case 820.

In the embodiment of FIGS. 8-10, the default automatic position holds the accessory or accessories in a visible or partially visible position, and the actuation of the mechanism partially or fully hides the accessories. The apparatus in the first embodiment is desirable when the user wishes the accessories to be hidden by default, and jaw movement causes the accessories to appear. The apparatus in the second embodiment is desirable when the user wishes the accessories to be visible by default, and jaw movement causes the accessories to be hidden. This embodiment is shown in FIGS. 19A, 19B, 20A, and 20B.

FIG. 8 shows an example of a perspective view of a mouth-operated moveable apparatus 800, in a first position, in a second embodiment of the present invention in accordance with aspects of the present disclosure. Mouth-operated moveable apparatus 800 may include band 805, case 820, bite plate 845, and actuator foot 855.

Band 805 may include band anchor 810 and band arm 815. Band 805 may be an example of, or include aspects of, the corresponding element or elements described with reference to FIGS. 1, 2, 4, 6, and 13. Band anchor 810 may be an example of, or include aspects of, the corresponding element or elements described with reference to FIGS. 1, 2, 4, 6, 7, and 11-13. Band arm 815 may be an example of, or include aspects of, the corresponding element or elements described with reference to FIGS. 1, 2, and 13.

Case 820 may include case body 825, case cover 830, slide opening 835, and top opening 840. Case 820 may be an example of, or include aspects of, the corresponding element or elements described with reference to FIGS. 1, 2, 4-7, and 11-13. Case body 825 may be an example of, or include aspects of, the corresponding element or elements described with reference to FIGS. 1, 4, 6, and 11-13. Case cover 830 may be an example of, or include aspects of, the corresponding element or elements described with reference to FIGS. 1, 4, 5, 11, and 13. Slide opening 835 and top opening 840 may be an example of, or include aspects of, the corresponding elements described with reference to FIGS. 4 and 7.

Bite plate 845 may include bite plate flange 850. Bite plate 845 and bite plate flange 850 may be examples of, or include aspects of, the corresponding elements described with reference to FIGS. 1, 2, 4, and 11. Actuator foot 855 may be an example of, or include aspects of, the corresponding element or elements described with reference to FIGS. 1-4, 11, and 13.

In some examples, the apparatus is configured such that when placed in the mouth at least a portion of the at least one accessory 165 is visible when the band 120 is in the first position, and each accessory 165 is not visible when the band 120 is in the second position.

In the embodiment of FIGS. 8 and 9 the apparatus is configured such that the first position is a downward position, and the second position is an upward position.

FIG. 9 shows an example of a sectional view of the mouth-operated moveable apparatus shown in FIG. 8, shown in the first position in accordance with aspects of the present disclosure. Mouth-operated moveable apparatus 900 may include slide plate pin 905, case pin 910, and slide plate 915.

As shown in FIGS. 9 and 10, the slide plate 915 and case pin 910 are reconfigured to provide the clockwise rotation of the band anchor instead of the counterclockwise rotation of the first embodiment. In the second embodiment, the locations of the case pin 910 and the slide plate pins 905 are reversed, with the slide plate pin 905 is located closer to the band arm than the case pin 910. The band anchor still pivots about the case pin 910 pivot point.

The slide plate 915 includes a vertical slot 920 to allow the slide plate 915 to move upwards without contacting or otherwise interfering with the case pin 910. As shown in FIG. 9, in the automatic first position the spring (or other suitable biasing element) holds the slide plate 915 in the downward position, resulting in a generally horizontal position of the band. When the mechanism is actuated by moving the actuator foot upwards (same as for the first embodiment), the slide plate pin 905 moves upward with respect to the case pin 910, rotating the band anchor in a clockwise direction about the case pin 910, which in turn causes the center portion of the band to move upwards.

Slide plate pin 905 may be an example of, or include aspects of, the corresponding element or elements described with reference to FIGS. 3, 5, and 10. Case pin 910 may be an example of, or include aspects of, the corresponding element or elements described with reference to FIGS. 5, 6, 10, 12, and 13.

Slide plate 915 may include slot 920. Slide plate 915 may be an example of, or include aspects of, the corresponding element or elements described with reference to FIGS. 1, 3-7, 10, 11, and 13. Slot 920 may be an example of, or include aspects of, the corresponding element or elements described with reference to FIGS. 10, 12, and 13.

FIG. 10 shows an example of an exploded view of a slide plate and a case body of the mouth-operated moveable apparatus of FIG. 8 in accordance with aspects of the present disclosure. Mouth-operated moveable apparatus 1000 may include slide plate pin 1005, case pin 1010, slide plate 1015, and case body 1025.

Slide plate pin 1005 may be an example of, or include aspects of, the corresponding element or elements described with reference to FIGS. 3, 5, and 9. Case pin 1010 may be an example of, or include aspects of, the corresponding element or elements described with reference to FIGS. 5, 6, 9, 12, and 13.

Slide plate 1015 may include slot 1020. Slide plate 1015 may be an example of, or include aspects of, the corresponding element or elements described with reference to FIGS. 1, 3-7, 9, 11, and 13. Slot 1020 may be an example of, or include aspects of, the corresponding element or elements described with reference to FIGS. 9, 12, and 13.

Figure 11:
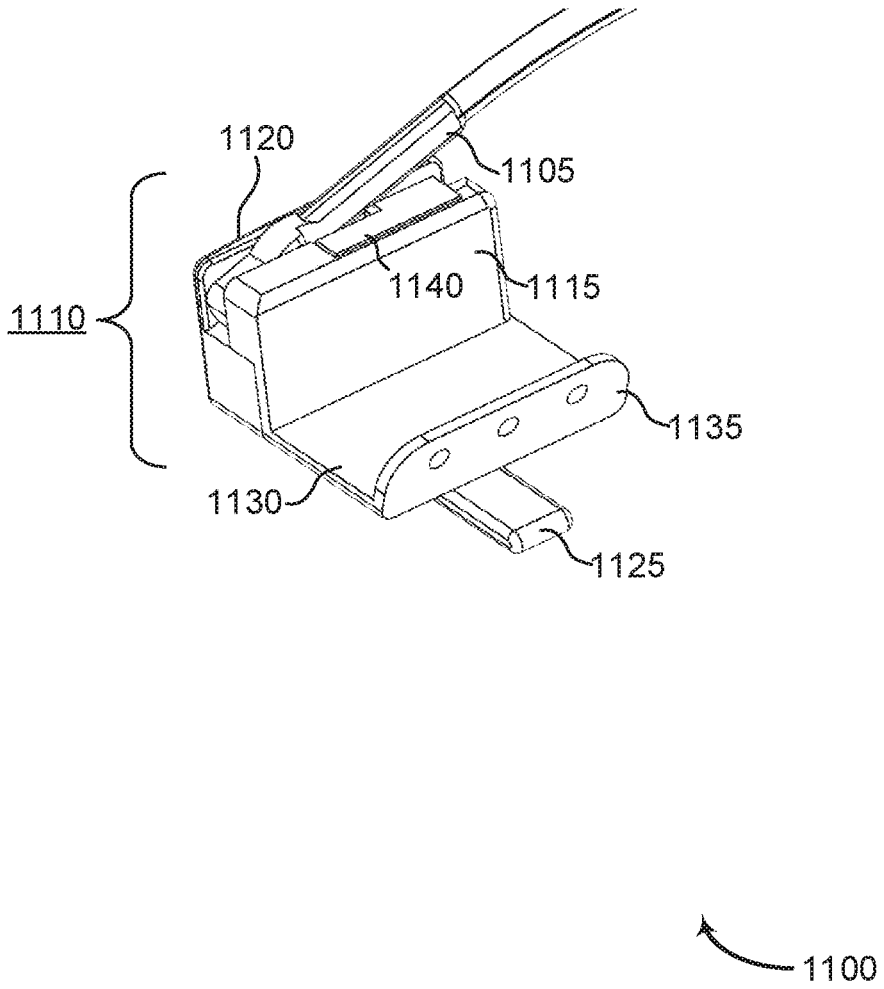
FIG. 11 shows an example of a perspective view of a mouth-operated moveable apparatus, with a band in an upward position, in a third embodiment of the present invention in accordance with aspects of the present disclosure.
Figure 12:
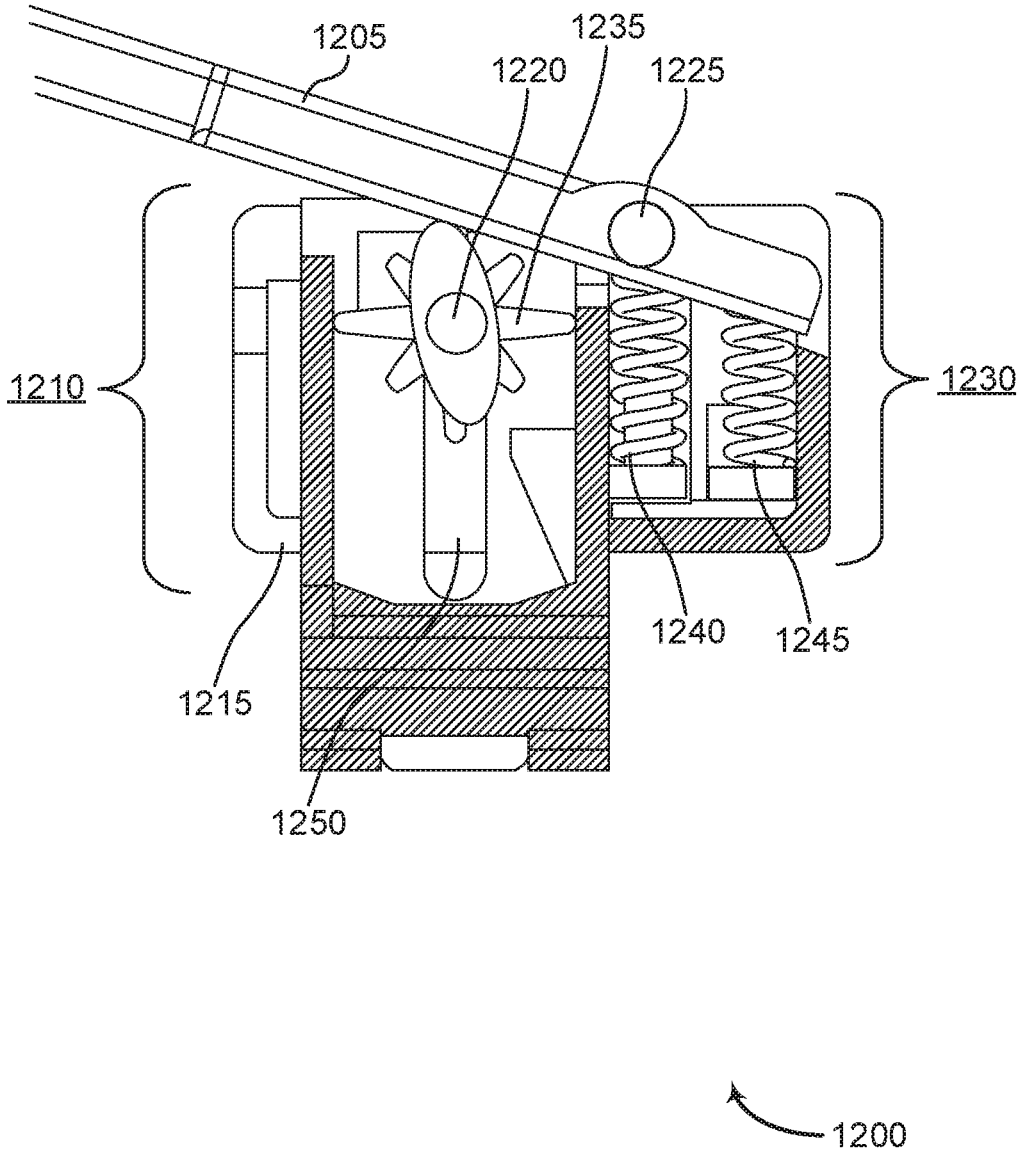
FIG. 12 shows an example of a sectional view of the mouth-operated moveable apparatus shown in FIG. 11 in accordance with aspects of the present disclosure.
Figure 13:
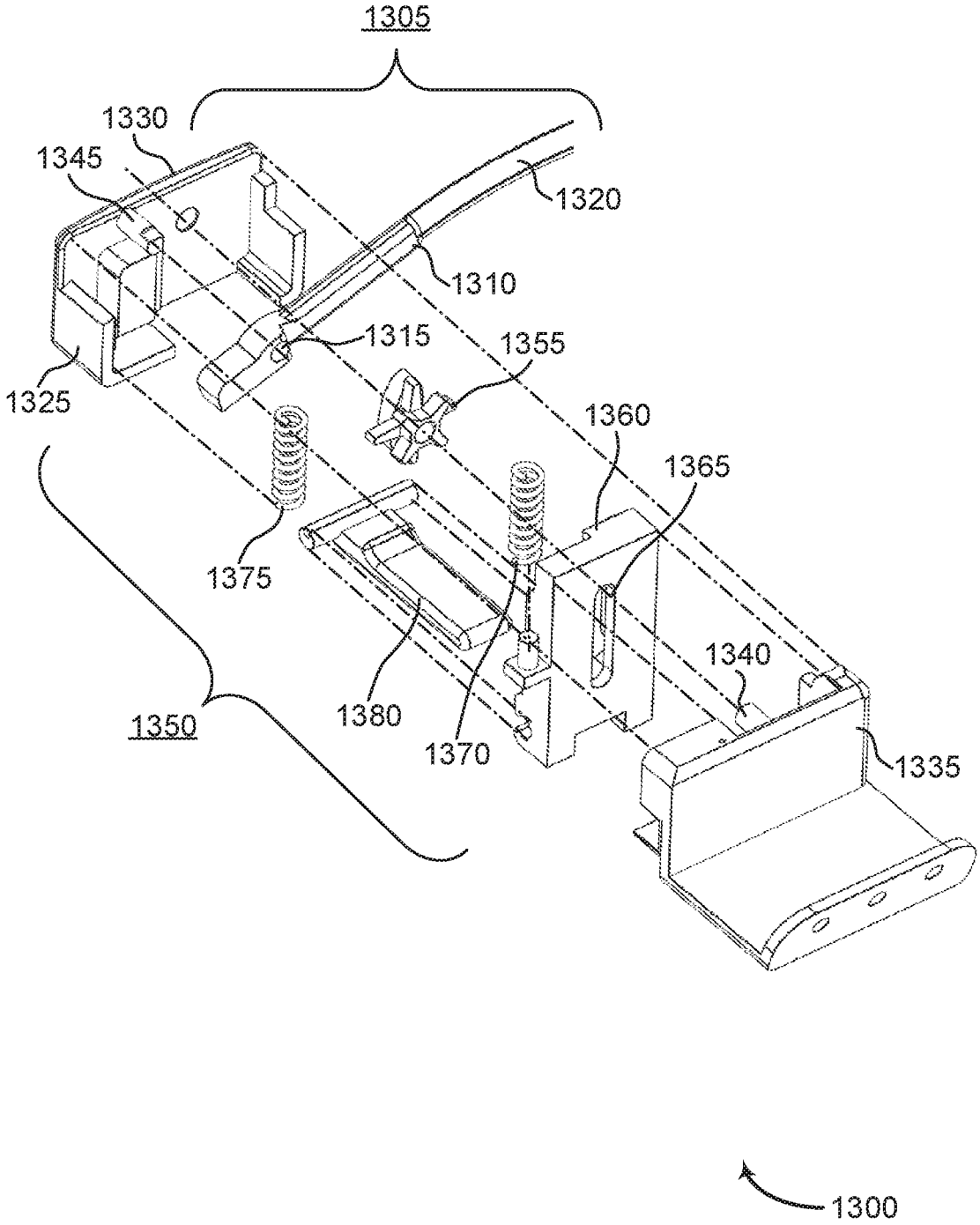
FIG. 13 shows an example of an exploded view of the mouth-operated moveable apparatus shown in FIG. 11 in accordance with aspects of the present disclosure.

In a third embodiment shown in FIGS. 11-13, the mechanism is configured to allow for a click-up/click-down movement of the band anchor. In FIGS. 11-13, the apparatus is shown in an upward position.

FIG. 11 shows an example of a perspective view of a mouth-operated moveable apparatus 1100, with a band in an upward position, in a third embodiment of the present invention in accordance with aspects of the present disclosure. Mouth-operated moveable apparatus 1100 may include band anchor 1105, case 1110, actuator foot 1125, bite plate 1130, and slide plate 1140.

Figure 18C:
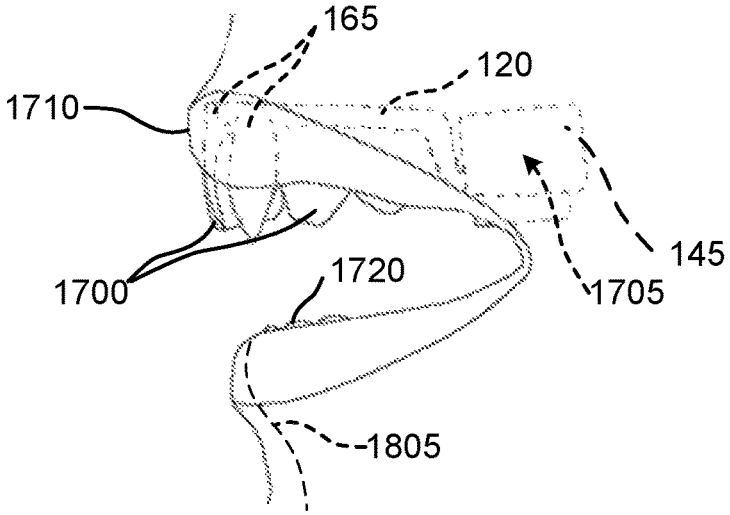
Figure 19A:
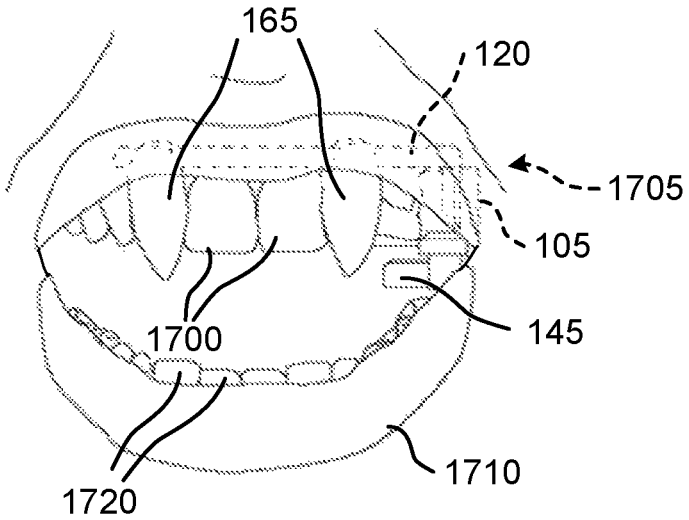
Figure 19B:
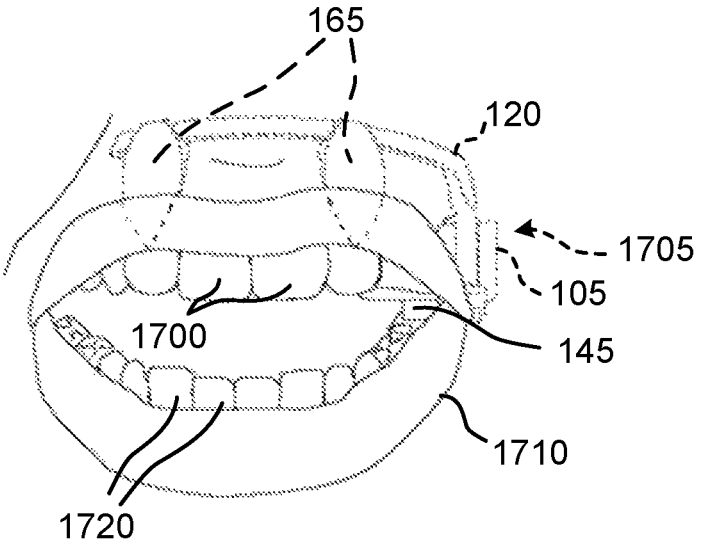
Figure 20A:
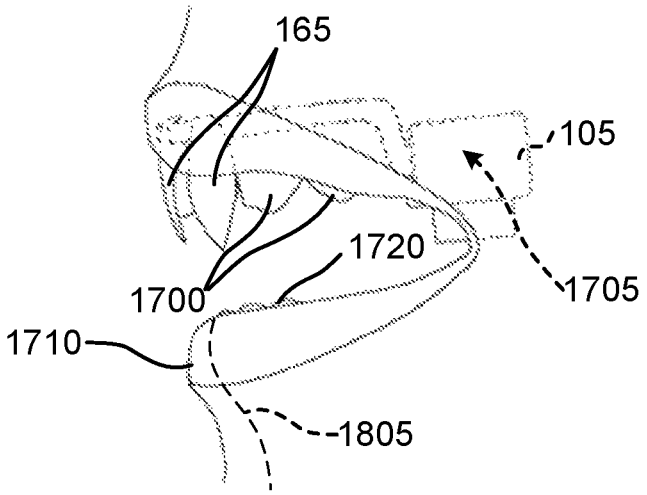
Figure 20B:
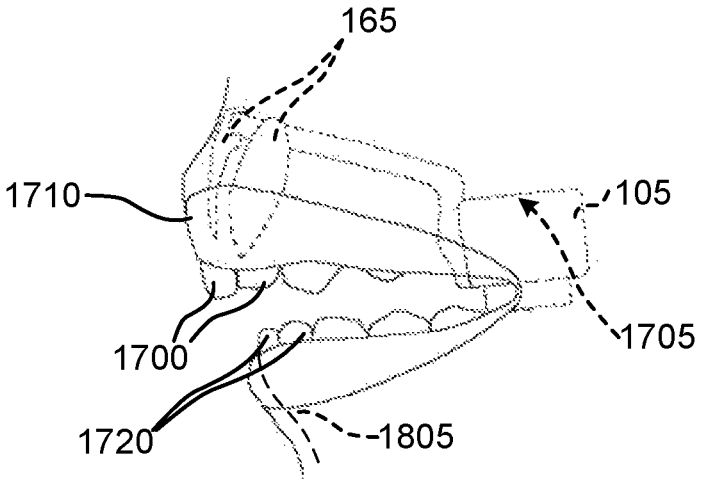

The mechanism of FIGS. 11-13 includes an additional spring (referred to as a second spring) housed in the case cover 1120. The second spring provides an upward biasing force against the end of the band anchor 1105, which automatically keeps the band anchor 1105 in the generally horizontal position. The internal gear apparatus is used to move the band to the upward position. This mechanism provides for a single "click" of the apparatus (the click comprising the user moving the actuator foot 1125 upwards towards the bite plate 1130 as far as possible and then releasing the actuator foot 1125) to move the band from the first position to the second (upward) position and vice versa. The band then is automatically held in the new position. An example of use of this embodiment is shown in FIGS. 18A-18C.

In this way, the user is not required to provide continuous jaw clenching to maintain the band in the second (non-automatic) position, as with the previous embodiments. The user clicks (move-and-release) once to move the band (for example, to the upward position), and upon the release the band is still held in that position. To move the band back (for example, back to the downward position), the user clicks again, and the band is returned to and held automatically in the previous position. This movement between the first position and the second position can be toggled by repeated clicking.

Band anchor 1105 may be an example of, or include aspects of, the corresponding element or elements described with reference to FIGS. 1, 2, 4, 6-8, 12, and 13.

Case 1110 may include case body 1115 and case cover 1120. Case 1110 may be an example of, or include aspects of, the corresponding element or elements described with reference to FIGS. 1, 2, 4-8, 12, and 13. Case body 1115 may be an example of, or include aspects of, the corresponding element or elements described with reference to FIGS. 1, 4, 6, 8, 12, and 13. Case cover 1120 may be an example of, or include aspects of, the corresponding element or elements described with reference to FIGS. 1, 4, 5, 8, and 13.

Actuator foot 1125 may be an example of, or include aspects of, the corresponding element or elements described with reference to FIGS. 1-4, 8, and 13.

Bite plate 1130 and bite plate flange 1135 may be examples of, or include aspects of, the corresponding elements described with reference to FIGS. 1, 2, 4, and 8. Slide plate 1140 may be an example of, or include aspects of, the corresponding element or elements described with reference to FIGS. 1, 3-7, 9, 10, and 13.

FIG. 12 shows an example of a sectional view of the mouth-operated moveable apparatus shown in FIG. 11 in accordance with aspects of the present disclosure. Mouth-operated moveable apparatus 1200 may include band anchor 1205, case 1210, and mechanism 1230.

Band anchor 1205 may be an example of, or include aspects of, the corresponding element or elements described with reference to FIGS. 1, 2, 4, 6-8, 11, and 13.

Case 1210 may include case body 1215, case pin 1220, and case cover pin 1225. Case 1210 may be an example of, or include aspects of, the corresponding element or elements described with reference to FIGS. 1, 2, 4-8, 11, and 13. Case body 1215 may be an example of, or include aspects of, the corresponding element or elements described with reference to FIGS. 1, 4, 6, 8, 11, and 13. Case pin 1220 may be an example of, or include aspects of, the corresponding element or elements described with reference to FIGS. 5, 6, 9, 10, and 13. Case cover pin 1225 may be an example of, or include aspects of, the corresponding element or elements described with reference to FIG. 13.

Mechanism 1230 may include gear assembly 1235, first spring 1240, second spring 1245, and slot 1250.

Gear assembly 1235, first spring 1240 and second spring 1245 may be examples of, or include aspects of, the corresponding elements described with reference to FIG. 13. Slot 1250 may be an example of, or include aspects of, the corresponding element or elements described with reference to FIGS. 9, 10, and 13.

FIG. 13 shows an example of an exploded view of the mouth-operated moveable apparatus shown in FIG. 11 in accordance with aspects of the present disclosure. Mouth-operated moveable apparatus 1300 may include band 1305, case 1325, mechanism 1350, and actuator foot 1380.

Band 1305 may include band anchor 1310 and band arm 1320. Band 1305 may be an example of, or include aspects of, the corresponding element or elements described with reference to FIGS. 1, 2, 4, 6, and 8. Band anchor 1310 may include hole 1315. Band anchor 1310 may be an example of, or include aspects of, the corresponding element or elements described with reference to FIGS. 1, 2, 4, 6-8, 11, and 12. Band arm 1320 may be an example of, or include aspects of, the corresponding element or elements described with reference to FIGS. 1, 2, and 8.

Case 1325 may include case body 1330, case cover 1335, case pin 1340, and case cover pin 1345. Case 1325 may be an example of, or include aspects of, the corresponding element or elements described with reference to FIGS. 1, 2, 4-8, 11, and 12. Case body 1330 may be an example of, or include aspects of, the corresponding element or elements described with reference to FIGS. 1, 4, 6, 8, 11, and 12. Case cover 1335 may be an example of, or include aspects of, the corresponding element or elements described with reference to FIGS. 1, 4, 5, 8, and 11. Case pin 1340 may be an example of, or include aspects of, the corresponding element or elements described with reference to FIGS. 5, 6, 9, 10, and 12. Case cover pin 1345 may be an example of, or include aspects of, the corresponding element or elements described with reference to FIG. 12.

Mechanism 1350 may include gear assembly 1355, slide plate 1360, first spring 1370, and second spring 1375. Gear assembly 1355 may be an example of, or include aspects of, the corresponding element or elements described with reference to FIG. 12.

Slide plate 1360 may include slot 1365. Slide plate 1360 may be an example of, or include aspects of, the corresponding element or elements described with reference to FIGS. 1, 3-7, and 9-11. Slot 1365 may be an example of, or include aspects of, the corresponding element or elements described with reference to FIGS. 9, 10, and 12.

First spring 1370 and second spring 1375 may be an example of, or include aspects of, the corresponding element or elements described with reference to FIG. 12.

Actuator foot 1380 may be an example of, or include aspects of, the corresponding element or elements described with reference to FIGS. 1-4, 8, and 11.

Figure 14:
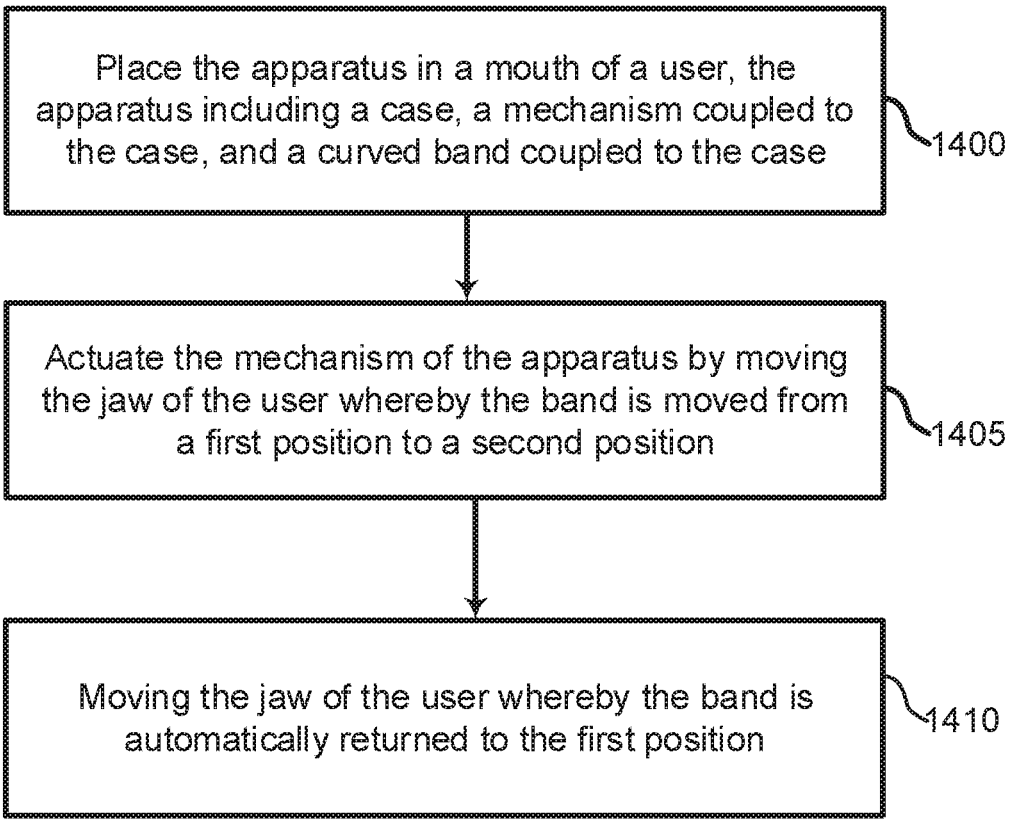
FIGS. 14 through 15 show examples of a process for operating a mouth-operated apparatus in accordance with aspects of the present disclosure.

FIG. 14 shows an example of a process for operating a mouth-operated apparatus in accordance with aspects of the present disclosure. Generally, these operations may be performed according to the methods and processes described in accordance with aspects of the present disclosure. For example, the operations may be composed of various sub-steps, or may be performed in conjunction with other operations described herein. In some embodiments, the process is performed with reference to the apparatus of FIG. 1. In other embodiments, the process is performed with reference to the apparatus of FIG. 8. In other embodiments, the process is performed with reference to the apparatus of FIG. 11.

At step 1400, a user may place the apparatus in the mouth, the apparatus including a case, a mechanism coupled to the case, and a curved band coupled to the case, as shown.

At step 1405, the user may actuate the mechanism of the apparatus by moving the jaw of the user whereby the band is moved from a first position to a second position.

At step 1419, the user may release or otherwise disengage from the mechanism of the apparatus by moving the jaw of the user whereby the band is automatically returned to the first position. In some embodiments the moving the jaw of the user in the opposite manner to the movement to actuate the mechanism.

As previously described, the movement of the band from the first position to the second position includes traveling through all intermediate positions between the first position and the second position.

Figure 15:
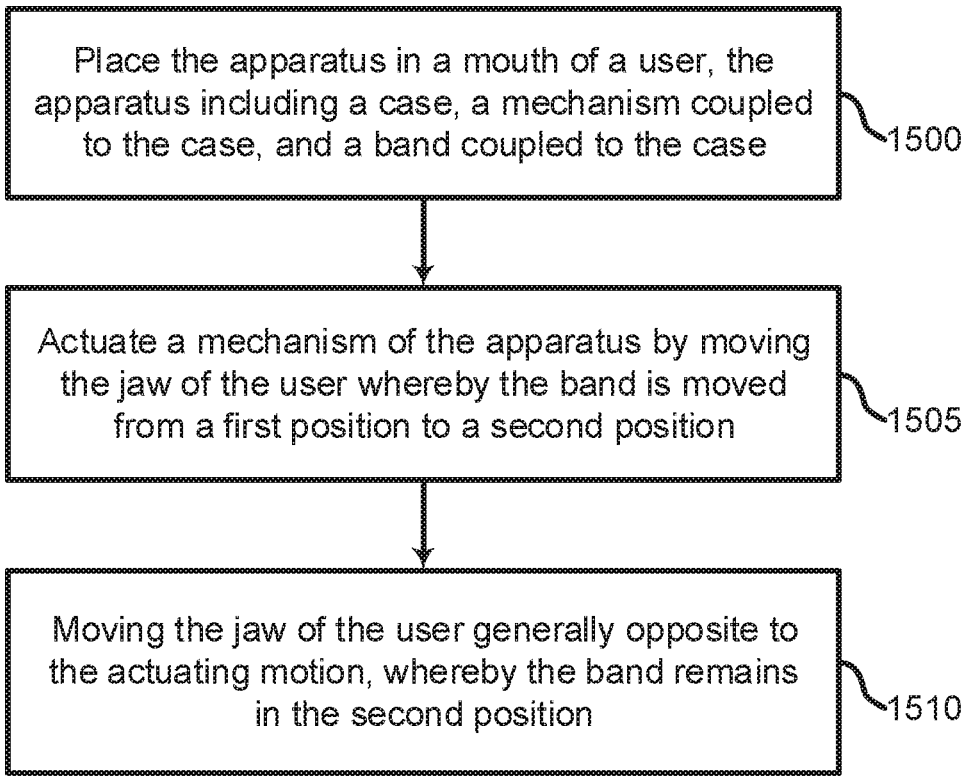

FIG. 15 shows an example of a process for operating a mouth-operated apparatus in accordance with aspects of the present disclosure. Generally, these operations may be performed according to the methods and processes described in accordance with aspects of the present disclosure. For example, the operations may be composed of various sub-steps, or may be performed in conjunction with other operations described herein.

At step 1500, a user may place the apparatus in the mouth, the apparatus including a case, a mechanism coupled to the case, and a band coupled to the case, as shown in FIG. 18A.

At step 1505, the user may actuate a mechanism of the apparatus by moving the jaw of the user whereby the band is moved from a first position to a second position, as shown in FIG. 18B.

At step 1510, the user may release (and/or disengage from) the mechanism by moving the jaw of the user generally opposite to the actuating motion, whereby the band remains in the second position, as shown in FIG. 18C.

Figure 16:
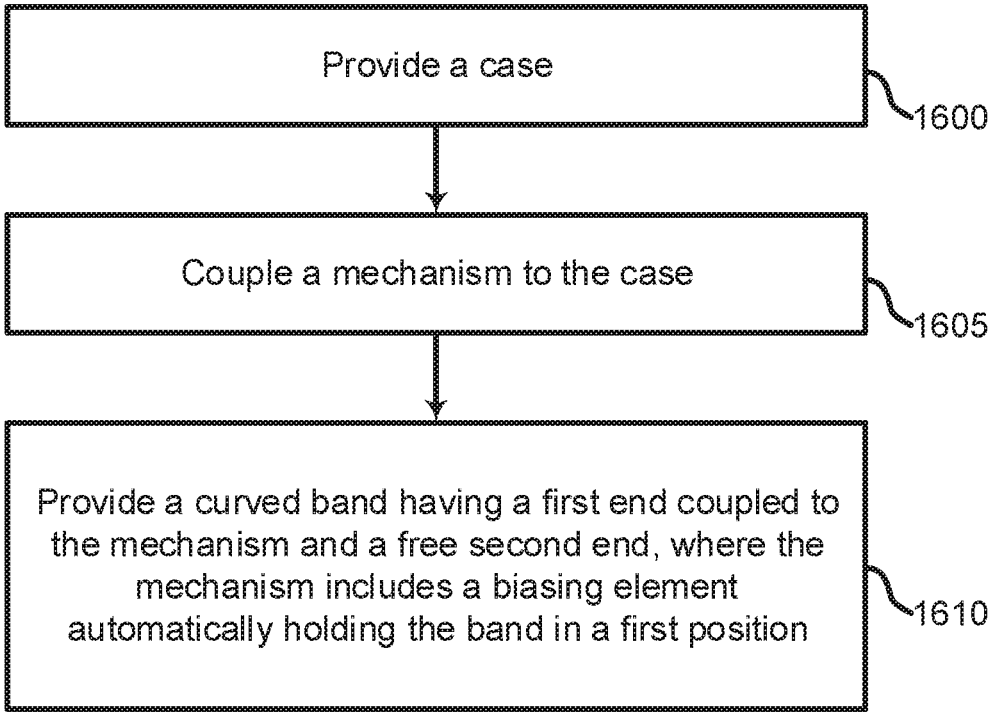
FIG. 16 shows an example of a process for manufacturing a mouth-operated apparatus in accordance with aspects of the present disclosure.

FIG. 16 shows an example of a process for manufacturing a mouth-operated apparatus in accordance with aspects of the present disclosure. Generally, these operations may be performed according to the methods and processes described in accordance with aspects of the present disclosure. For example, the operations may be composed of various sub-steps, or may be performed in conjunction with other operations described herein.

At step 1600, the manufacturing system may provide a case.

At step 1605, the manufacturing system may couple a mechanism to the case.

At step 1610, the manufacturing system may provide a curved band having a first end coupled to the mechanism and a free second end.

In some case, the mechanism includes a biasing element automatically holding the band in a first position, where the case and mechanism are configured such that when the apparatus is placed in the mouth of a user the mechanism is actuatable by a jaw movement of the user, and where the actuation of the mechanism moves the band from the first position to a second position.

While the invention herein disclosed has been described by means of specific embodiments, examples and applications thereof, numerous modifications and variations could be made thereto by those skilled in the art without departing from the scope of the invention set forth in the claims.

What is claimed is:

1. A mouth-operated movable apparatus, comprising:

a case;

a mechanism coupled to the case; and a curved band having a first end coupled to the mechanism and a free second end, wherein the mechanism includes a biasing element automatically holding the band in a first position, wherein the case and mechanism are configured such that when the apparatus is placed in the mouth of a user the mechanism is actuatable by a jaw movement of the user, and wherein the actuation of the mechanism moves the band from the first position to a second position.

2. The apparatus of claim 1, wherein:

the first position is an upper position relative to the mouth of the user when the apparatus is placed in the mouth and the second position is a lower position relative to the mouth.

3. The apparatus of claim 1, wherein:

the first position is a lower position relative to the mouth of the user when the apparatus is placed in the mouth and the second position is an upper position relative to the mouth.

4. The apparatus of claim 1, the mechanism further comprising:

a slide plate moveably coupled to the case, wherein the coupling of the first end to the mechanism includes a pivotal coupling of the first band end to the slide plate, and wherein actuating of the mechanism includes moving of the slide plate relative to the case, whereby the first band end is pivoted about the pivotal coupling to the case.

5. The apparatus of claim 1, wherein:

the actuation comprises moving an actuator portion of the mechanism relative to the case.

6. The apparatus of claim 1, further comprising:

a case body;

a generally horizontal bite plate located proximate to a lower edge of the case body and extending outward from the case body towards the mouth interior when the apparatus is placed in the mouth; and an actuator foot coupled to a lower end of the mechanism, wherein when the actuator foot is oriented generally parallel to and underneath the bite plate, the mechanism is actuatable by moving the actuator foot upwards towards the bite plate.

7. The apparatus of claim 1, wherein the mechanism is further configured such that the band is automatically held in the second position.

8. The apparatus of claim 1, wherein:

the band is located between an outer surface of the teeth of the user and an inner cheek of the user when the apparatus is placed in the mouth of the user.

9. The apparatus of claim 1, wherein:

the biasing element is configured to bias the mechanism downward.

10. The apparatus of claim 1, wherein:

the band is configured to removably couple to at least one accessory.

11. The apparatus of claim 10, further comprising:

at least one accessory coupled to the band.

12. The apparatus of claim 11, wherein:

the apparatus is configured such that when placed in the mouth and the jaw is in a rest position at least a portion of the at least one accessory is visible when the band is in the first position, and each accessory is not visible when the band is in the second position.

13. The apparatus of claim 11, wherein:

the apparatus is configured such that when placed in the mouth and the law as in a rest position each accessory is not visible when the band is in the first position, and at least a portion of the at least one accessory is visible when the band is in the second position.

14. A method for operating a mouth-operated apparatus, comprising:

placing the apparatus in a mouth of a user, the apparatus comprising a case, a mechanism coupled to the case, and a curved band coupled to the case having a first end coupled to the mechanism and a free second end, wherein the mechanism includes a biasing element automatically holding the band in a first position, wherein the case and mechanism are configured such that when the apparatus is placed in the mouth of a user the mechanism is actuatable by a jaw movement of the user; and actuating the mechanism of the apparatus by moving the jaw of the user whereby the band is moved from the first position to the second position.

15. The method of claim 14, wherein:

the placing of the apparatus in the mouth of the user includes locating a portion of the case and a portion of the mechanism between upper and lower teeth of the user, and wherein actuating the mechanism includes biting of the portions of the case and mechanism between the upper and lower teeth of the user.

16. The method of claim 14, wherein:

the placing of the apparatus in the mouth includes the band being juxtaposed with and generally following an outer surface of at least one of the user's upper teeth and the user's upper gums.

17. The method of claim 14, further comprising:

moving the jaw of the user in the reverse of the actuating movement, whereby the band automatically moves from the second position back to the first position.

18. The method of claim 14, further comprising:

coupling of at least one accessory to the band prior to actuating.

19. The method of claim 18, wherein:

at least one of the at least one accessory is not visible when the user's jaw is in a rest position and the band is in the first position, and wherein the accessory is at least partially visible when the user's jaw is in a rest position and the band is in the second position.

20. The method of claim 18, wherein:

at least one of the at least one accessory is at least partially visible when the user's jaw is in a rest position and the band is in the first position, and wherein the accessory is not visible when the user's jaw is in a rest position and the band is in the second position.

21. The method of claim 14, further comprising:

moving the jaw of the user in the reverse of the actuating movement, whereby the band is automatically held in the second position.

* * * * *